US011749150B2

(12) United States Patent
Kwun et al.

(10) Patent No.: US 11,749,150 B2
(45) Date of Patent: Sep. 5, 2023

(54) DISPLAY DEVICE, COMPENSATION SYSTEM, AND COMPENSATION DATA COMPRESSION METHOD

(71) Applicant: LG DISPLAY CO., LTD., Seoul (KR)

(72) Inventors: Sunwoo Kwun, Incheon (KR); Seho Lim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/873,593

(22) Filed: Jul. 26, 2022

(65) Prior Publication Data

US 2023/0095441 A1 Mar. 30, 2023

(30) Foreign Application Priority Data

Sep. 30, 2021 (KR) ..... 10-2021-0129631

(51) Int. Cl.
*G09G 3/00* (2006.01)
*G09G 3/3291* (2016.01)

(52) U.S. Cl.
CPC ..... *G09G 3/006* (2013.01); *G09G 3/3291* (2013.01); *G09G 2320/0242* (2013.01); *G09G 2330/12* (2013.01); *G09G 2340/14* (2013.01)

(58) Field of Classification Search
CPC .... G09G 3/006; G09G 3/3291; G09G 3/3233; H03M 7/6011; H03M 7/6041; H04N 19/10
See application file for complete search history.

(56) References Cited

U.S. PATENT DOCUMENTS

| | | | | |
|---|---|---|---|---|
| 10,200,685 | B2 * | 2/2019 | Gilmutdinov | H04N 19/124 |
| 10,742,914 | B2 * | 8/2020 | Taketomi | H04N 23/63 |
| 10,826,527 | B2 * | 11/2020 | Wei | H03M 7/30 |
| 10,971,081 | B2 * | 4/2021 | Kang | G09G 3/3266 |
| 2016/0189593 | A1 * | 6/2016 | Lee | G09G 3/3291 438/4 |

* cited by examiner

*Primary Examiner* — Sardis F Azongha
(74) *Attorney, Agent, or Firm* — Morgan, Lewis & Bockius LLP

(57) ABSTRACT

A display device, a compensation system, and a compensation data compression method. The display device includes a display panel including a plurality of subpixels, a compensation module generating compensation data regarding subpixels disposed in a normal area, a fixed pattern area, and a bad pixel area, and a compression module generating compressed compensation data by compressing the compensation data. The compressed compensation data includes compressed compensation data regarding the normal area, compressed compensation data regarding the fixed pattern area, and compressed compensation data regarding the bad pixel area. The compressed compensation data regarding the normal area includes normal compensation data processed by encoding, the compressed compensation data regarding the fixed pattern area include fixed compensation data processed by the encoding and error information resulting from the encoding, and the compressed compensation data regarding the bad pixel area includes a flag regarding the bad pixel area.

19 Claims, 19 Drawing Sheets

Sensing-less Compensating System

B1'' : Fixed compensation data of lost and sampled fixed pattern area FPA

B1'' : Fixed compensation data of lost and sampled fixed pattern area FPA

DISPLAY DEVICE, COMPENSATION SYSTEM, AND COMPENSATION DATA COMPRESSION METHOD

CROSS REFERENCE TO RELATED APPLICATION

This application claims priority from Korean Patent Application No. 10-2021-0129631, filed on Sep. 30, 2021, which is hereby incorporated by reference for all purposes as if fully set forth herein.

BACKGROUND

Technical Field

Embodiments of the present disclosure relate to a display device, a compensation system, and a compensation data compression method.

Discussion of the Related Art

Among display devices currently being developed, there is provided a self-emissive display device including a display panel capable of emitting light by itself. The display panel of such a self-emissive display device may include subpixels respectively including an emitting device, a driving transistor for driving the emitting device, and the like in order to emit light by itself.

Each of the circuit devices, such as driving transistors and emitting devices, disposed in the display panel of such a self-emissive display device has unique characteristics. For example, unique characteristics of each driving transistor include a threshold voltage, mobility, and the like. Unique characteristics of each emitting device include a threshold voltage and the like.

Circuit devices in each subpixel may degrade over driving time, and thus the unique characteristics thereof may change. Since the subpixels may have different driving times, characteristics of a circuit device in each subpixel may have different degrees of change from those of a circuit device in another subpixel. Thus, characteristic deviation may occur among the subpixels over driving time, thereby resulting in luminance deviation among the subpixels. The luminance deviation among the subpixels may be a major factor in reducing brightness uniformity of a display device, thereby deteriorating the quality of images.

Accordingly, a variety of compensation methods for compensating for the luminance deviation among the subpixels have been developed. A display device to which compensation technology is applied may compensate for the luminance deviation among subpixels thereof by generating and storing compensation data, including compensation values of the subpixels, by which a characteristic deviation among circuit devices in the subpixels may be compensated for, and may change image data on the basis of the compensation data.

SUMMARY

A related-art compensation technology must previously generate and store compensation data regarding subpixels before driving of image data in order to compensate for a luminance deviation among the subpixels. Since a significantly large number of subpixels are disposed in a display panel, the compensation data regarding the subpixels may be a significantly large amount of data. In accordance with increases in the number of the subpixels in response to the increasing resolution of the display panel, the amount of the compensation data will increase significantly. When the amount of the compensation data is increased as described above, the capacity of a storage (e.g., the capacity of a storage space) should also be increased, which may be problematic. Accordingly, the inventor of the present application has conceived of a display device, a compensation system, and a compensation data compression method able to reduce the amount of compensation data.

Furthermore, the inventor of the present application has discovered that, when compensation data is stored in a compressed state and display driving is performed by decompressing the compressed compensation data and modulating image data, an image abnormality may occur or an afterimage may be induced by the compression of the compensation data, and thus conceived of a display device, a compensation system, and a compensation data compression method able to prevent the occurrence of image abnormalities and afterimages.

Accordingly, embodiments of the present disclosure are directed to a display device, a compensation system, and a compensation data compression method that substantially obviate one or more of the problems due to limitations and disadvantages of the related art.

An aspect of the present disclosure is to provide a display device, a compensation system, and a compensation data compression method for reducing the amount of compensation data.

An aspect of the present disclosure is to provide a display device, a compensation system, and a compensation data compression method for preventing image abnormalities and afterimages caused by the compression of compensation data.

An aspect of the present disclosure is to provide a display device, a compensation system, and a compensation data compression method for compressing compensation data differently in an area specific manner.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises: a display panel including a plurality of subpixels; a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include compressed compensation data regarding the normal area, compressed compensation data regarding the fixed pattern area, and compressed compensation data regarding the bad pixel area.

The compressed compensation data regarding the normal area may include normal compensation data processed by encoding, the compressed compensation data regarding the fixed pattern area include fixed compensation data processed by the encoding and error information resulting from the encoding, and the compressed compensation data regarding the bad pixel area includes a flag regarding the bad pixel area.

The encoding may be a discrete cosine transform (DCT).

The flag of the bad pixel area which is the compressed compensation data regarding the bad pixel area may include losslessly compressed data.

The display device may further include: a first memory storing error information resulting from the encoding and the flag of the bad pixel area; and a second memory storing the normal compensation data processed by the encoding.

The second memory may be different from the first memory.

The flag may include coordinate information and pixel information regarding at least one subpixel disposed in the bad pixel area.

The normal area may be an area having a more low-frequency component, and the fixed pattern area may be an area having a more high-frequency component.

The normal area may contain a more compensation data component of a first frequency than a compensation data component of a second frequency higher than the first frequency. The fixed pattern area may contain a more compensation data component having the second frequency than a compensation data component having the first frequency. A first ratio between the low-frequency compensation data and the high-frequency compensation data in the normal area may be different from a second ratio between the low-frequency compensation data and the high-frequency compensation data in the fixed pattern area. In other words, the normal area may be an area having more low-frequency compensation data components, and the fixed pattern area may be an area having more high-frequency compensation data components. Also, in other words, in the normal area, the amount of compensation data of the first frequency (low-frequency) may be greater than that of the second frequency (high-frequency), and in the fixed pattern area, the amount of compensation data of the second frequency (high-frequency) may be greater than that of the first frequency (low-frequency). Here, the second frequency is a high frequency, and may be a frequency greater than or equal to a predefined value. In addition, the first frequency is a low frequency, and may be a frequency less than a predefined value.

The encoding may cause a loss to the compensation data component of the second frequency.

Coefficients of correlation of compensation values regarding the subpixels included in the compensation data regarding the fixed pattern area may be lower than coefficients of correlation of compensation values regarding the subpixels included in the compensation data regarding the normal area.

In another aspect, a compensation data compression method comprises: generating compensation data regarding subpixels disposed in a normal area, a fixed pattern area, and a bad pixel area; generating compressed compensation data by compressing the compensation data; and storing the compressed compensation data.

The compressed compensation data may include compressed compensation data regarding the normal area, compressed compensation data regarding the fixed pattern area, and compressed compensation data regarding the bad pixel area.

The compressed compensation data regarding the normal area includes normal compensation data processed by encoding, the compressed compensation data regarding the fixed pattern area may include fixed compensation data processed by the encoding and error information resulting from the encoding, and the compressed compensation data regarding the bad pixel area includes a flag regarding the bad pixel area.

The encoding may be a DCT.

The flag of the bad pixel area which is the compressed compensation data regarding the bad pixel area may be losslessly compressed data.

Coefficients of correlation of compensation values regarding the subpixels included in the compensation data regarding the fixed pattern area may be lower than coefficients of correlation of compensation values regarding the subpixels included in the compensation data regarding the normal area.

In another aspect, a compensation system comprises: a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include compressed compensation data regarding the normal area, compressed compensation data regarding the fixed pattern area, and compressed compensation data regarding the bad pixel area.

The compressed compensation data regarding the normal area may include normal compensation data processed by encoding, the compressed compensation data regarding the fixed pattern area include fixed compensation data processed by the encoding and error information resulting from the encoding, and the compressed compensation data regarding the bad pixel area includes a flag regarding the bad pixel area.

The flag of the bad pixel area which is the compressed compensation data regarding the bad pixel area may be losslessly compressed data.

In another aspect, a compensation system comprises: a display panel including a plurality of subpixels; a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include normal compensation data regarding the normal area, fixed compensation data regarding the fixed pattern area, and a flag regarding the bad pixel area.

The compression module may generate the compressed compensation data by compressing the normal compensation data, the fixed compensation data, and the flag in different manners.

The normal compensation data may be compressed by a DCT.

The flag may be included in the compressed compensation data in a lossless state.

According to embodiments, the display device, the compensation system, and the compensation data compression method can reduce the amount of compensation data.

According to embodiments, the display device, the compensation system, and the compensation data compression method can prevent image abnormalities and afterimages caused by the compression of compensation data.

According to embodiments, the display device, the compensation system, and the compensation data compression method can compress compensation data differently in an area-specific manner.

It is to be understood that both the foregoing general description and the following detailed description are exemplary and explanatory and are intended to provide further explanation of the inventive concepts as claimed.

BRIEF DESCRIPTION OF DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
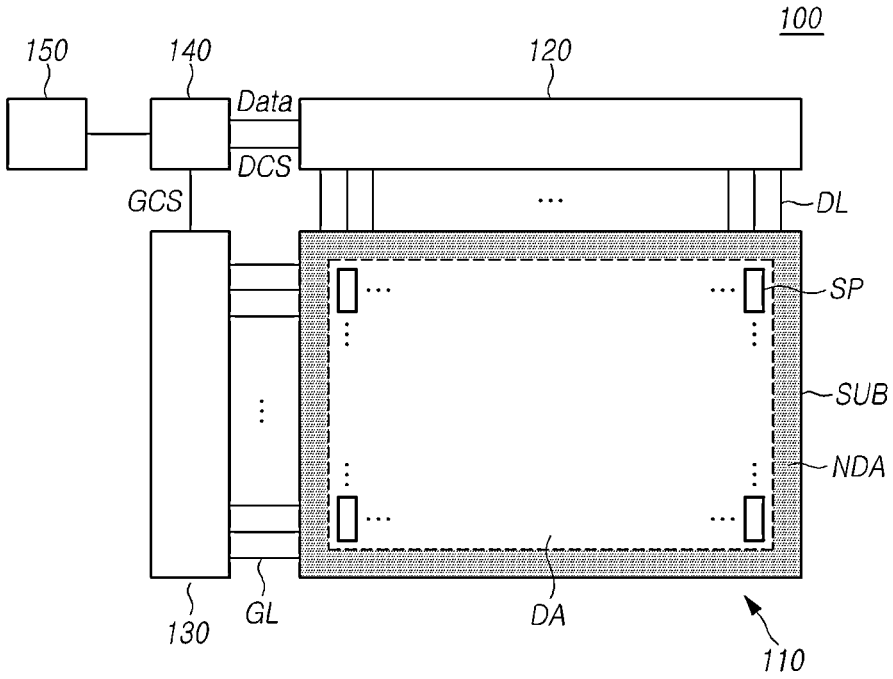
FIG. 1 is a diagram illustrating a system configuration of a display device according to embodiments.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting" "made up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a diagram illustrating a system configuration of a display device 100 according to embodiments.

Referring to FIG. 1, a display driving system of the display device 100 according to embodiments may include a display panel 110 and a display driver circuit driving the display panel 110.

The display panel 110 may include a display area DA on which images are displayed and a non-display area NDA on which images are not displayed. The display panel 110 may include a plurality of subpixels SP disposed on a substrate SUB.

For example, the plurality of subpixels SP may be disposed in the display area DA. In some cases, at least one subpixel SP may be disposed in the non-display area NDA. The at least one subpixel SP disposed in the non-display area NDA is also referred to as a dummy subpixel.

The display panel 110 may include a plurality of signal lines to drive the plurality of subpixels SP. For example, the plurality of signal lines may include a plurality of data lines DL and a plurality of gate lines GL. The signal lines may further include other signal lines, in addition to the plurality of data lines DL and the plurality of gate lines GL, depending on the structure of the subpixels SP. For example, the other signals lines may include driving voltage lines (DVLs), and the like.

The plurality of data lines DL may intersect the plurality of gate lines GL. Each of the plurality of data lines DL may be arranged to extend in a first direction. Each of the plurality of gate lines GL may be arranged to extend in a second direction. Here, the first direction may be a column direction, whereas the second direction may be a row direction. The column direction and the row direction used herein are relative terms. In an example, the column direction may be a vertical direction, whereas the row direction may be a horizontal direction. In another example, the column direction may be a horizontal direction, whereas the row direction may be a vertical direction.

The display driver circuit may include a data driver circuit 120 to drive the plurality of data lines DL and a gate driver circuit 130 to drive the plurality of gate lines GL. The display driver circuit may further include a controller 140 to drive the data driver circuit 120 and the gate driver circuit 130.

The data driver circuit 120 is a circuit to drive the plurality of data lines DL. The data driver circuit 120 may output data voltages (also referred to as data signals) corresponding to image signals through the plurality of data lines DL.

The gate driver circuit 130 is a circuit to drive the plurality of gate lines GL. The gate driver circuit 130 may generate gate signals and output the gate signals through the plurality of gate lines GL.

The controller 140 may start scanning at points in time defined for respective frames and control the data driving at appropriate times in response to the scanning. The controller 140 may convert image data input from an external source into image data having a data signal format readable by the data driver circuit 120, and transfer the converted image data to the data driver circuit 120.

The controller 140 may receive display drive control signals together with the input image data from an external host system 150. For example, the display drive control signals may include a vertical synchronization signal Vsync, a horizontal synchronization signal Hsync, an input data enable signal DE, a clock signal, and the like.

The controller 140 may generate data drive control signals DCS and gate drive control signals GCS on the basis of the display drive control signals (e.g., Vsync, Hsync, DE, and a clock signal) input from the host system 150. The controller 140 may control drive operations and drive timing of the data driver circuit 120 by transferring the data drive control signals to the data driver circuit 120. Here, the data drive control signals DCS and gate drive control signals GCS may be control signals included in the display drive control signals.

The controller 140 may control drive operations and drive timing of the data driver circuit 120 by transferring the data drive control signals to the data driver circuit 120. For example, the data drive control signals DCS may include a source start pulse (SSP), a source sampling clock (SSC), a source output enable signal (SOE), and the like.

The controller 140 may control drive operations and drive timing of the gate driver circuit 130 by transferring the gate drive control signals GCS to the gate driver circuit 130. For example, the gate drive control signals GCS may include a gate start pulse (GSP), a gate shift clock (GSC), a gate output enable signal (GOE), and the like.

The data driver circuit 120 may include one or more source driver integrated circuits (SDICs). Each of the SDICs may include a shift register, a latch circuit, a digital-to-analog converter (DAC), an output buffer, and the like. In some cases, each of the SDICs may further include an analog-to-digital converter (ADC).

For example, each of the SDICs may be connected to the display panel 110 by a tape-automated bonding (TAB) method, connected to a bonding pad of the display panel 110 by a chip-on-glass (COG) method or a chip on panel (COP) method, or implemented using a chip-on-film (COF) structure connected to the display panel 110.

The gate driver circuit 130 may output a gate signal having a turn-on level voltage or a gate signal having a turn-off level voltage under the control of the controller 140. The gate driver circuit 130 may sequentially drive the plurality of gate lines GL by sequentially transferring the gate signal having a turn-on level voltage to the plurality of gate lines GL.

The gate driver circuit 130 may be connected to the display panel 110 by a TAB method, connected to a bonding pad of the display panel 110 by a COG method or a COP method, or connected to the display panel 110 by a COF method. Alternatively, the gate driver circuit 130 may be formed in the non-display area NDA of the display panel 110 by a gate-in-panel (GIP) method. The gate driver circuit 130 may be disposed on the substrate SUB or connected to the substrate SUB. That is, when the gate driver circuit 130 is a GIP type, the gate driver circuit 130 may be disposed in the non-display area NDA of the substrate SUB. When the gate driver circuit 130 is a COG type, a COF type, or the like, the gate driver circuit 130 may be connected to the substrate SUB.

In addition, at least one driver circuit of the data driver circuit 120 and the gate driver circuit 130 may be disposed in the display area DA. For example, at least one display driver circuit of the data driver circuit 120 and the gate driver circuit 130 may be disposed to not overlap the subpixels SP or to overlap some or all of the subpixels SP.

When one gate line GL among the plurality of gate lines GL is driven by the gate driver circuit 130, the data driver circuit 120 may convert the image data, received from the controller 140, into an analog data voltage Vdata and supply the analog data voltage Vdata to the plurality of data lines DL.

The data driver circuit 120 may be connected to one side (e.g., a top side or a bottom side) of the display panel 110. The data driver circuit 120 may be connected to both sides (e.g., both the top side and the bottom side) of the display panel 110 or connected to two or more sides among the four sides of the display panel 110, depending on the driving method, the design of the display panel, or the like.

The gate driver circuit 130 may be connected to one side (e.g., a left side or a right side) of the display panel 110. The gate driver circuit 130 may be connected to both sides (e.g., both the left side and the right side) of the display panel 110 or connected to two or more sides among four sides of the of the display panel 110, depending on the driving method, the design of the display panel, or the like.

The controller 140 may be provided as a component separate from the data driver circuit 120 or may be combined with the data driver circuit 120 to form an integrated circuit (IC).

The controller 140 may be a timing controller typically used in the display field, may be a control device including a timing controller and able to perform other control functions, may be a control device different from the timing controller, or may be a circuit in a control device. The controller 140 may be implemented as a variety of circuits or electronic components, such as an integrated circuit (IC), a field programmable gate array (FPGA), an application specific integrated circuit (ASIC), a processor, or the like.

The controller 140 may be mounted on a printed circuit board (PCB), a flexible printed circuit (FPC), or the like, and electrically connected to the data driver circuit 120 and the gate driver circuit 130 through the PCB, the FPC, or the like.

The controller 140 may transmit signals to or receive signals from the data driver circuit 120 through at least one predetermined interface. Here, for example, the interface may include a low-voltage differential signaling (LVDS) interface, an eValid programmatic interface (EPI), a serial peripheral (SP) interface, and the like.

The display device 100 according to embodiments may be a self-emissive display device in which the display panel 110 emits light by itself. When the display device 100 according to embodiments is a self-emissive display device, each of the plurality of subpixels SP may include an emitting device (ED).

For example, the display device 100 according to embodiments may be an organic light-emitting display device in which the emitting device is implemented as an organic light-emitting diode (OLED). In another example, the display device 100 according to embodiments may be an inorganic light-emitting display device in which the emitting device is implemented as an OLED based on an inorganic material. In another example, the display device 100 according to embodiments may be a quantum dot display device in which the emitting device is implemented as a quantum dot that is a self-emissive semiconductor crystal.

Figure 2:
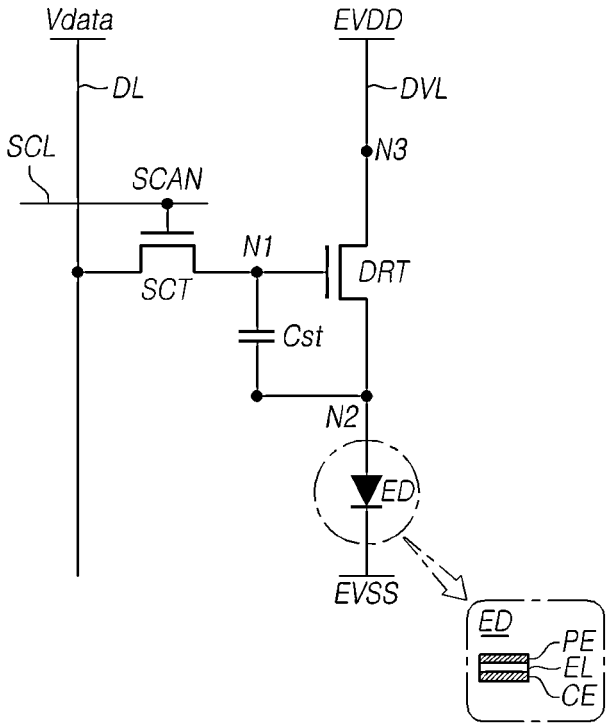
FIG. 2 illustrates an equivalent circuit of a subpixel SP in the display device according to embodiments.
Figure 3:
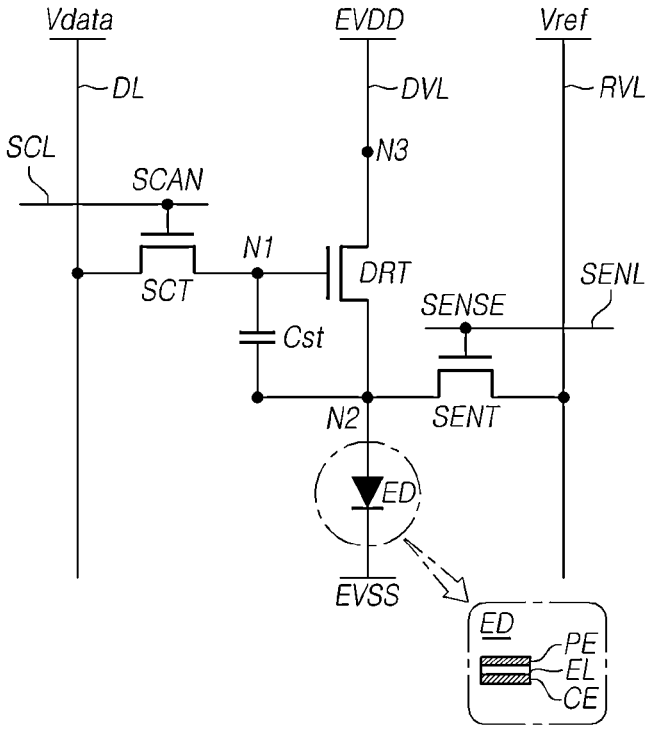
FIG. 3 illustrates another equivalent circuit of each of the subpixels in the display device according to embodiments.

FIG. 2 illustrates an equivalent circuit of each of the subpixels SP in the display device 100 according to embodiments, and FIG. 3 illustrates another equivalent circuit of each of the subpixels SP in the display device 100 according to embodiments.

Referring to FIG. 2, in the display device 100 according to embodiments, each of the subpixels SP includes an emitting device ED, a driving transistor DRT supplying a drive current to the emitting device ED to drive the emitting device ED, a scan transistor SCT transferring a data voltage Vdata to the driving transistor DRT, a storage capacitor Cst maintaining a voltage for a predetermined period, and the like.

The emitting device ED may include a pixel electrode PE, a common electrode CE, and an emissive layer EL positioned between the pixel electrode PE and the common electrode CE. The pixel electrode PE of the emitting device ED may be an anode or a cathode. The common electrode CE may be a cathode or an anode. The emitting device ED may be, for example, an organic light-emitting diode (OLED), a light-emitting diode (LED) based on an inorganic material, a quantum dot light-emitting device, or the like.

A base voltage EVSS corresponding to a common voltage may be applied to the common electrode CE of the emitting device ED. Here, the base voltage EVSS may be, for example, a ground voltage or a voltage similar to the ground voltage.

The driving transistor DRT may be a transistor for driving the emitting device ED, and include the first node N1, the second node N2, a third node N3, and the like.

The first node N1 of the driving transistor DRT may be a node corresponding to a gate node, and be electrically connected to a source node or a drain node of the scan transistor SCT. The second node N2 of the driving transistor DRT may be a source node or a drain node, and be electrically connected to the pixel electrode PE of the emitting device ED. The third node N3 of the driving transistor DRT may be a drain node or a source node, and be electrically connected to a driving voltage line DVL through which a driving voltage EVDD is supplied. Hereinafter, for the sake of brevity, the second node N2 of the driving transistor DRT will be described as being a source node, whereas the third node N3 will be described as being a drain node.

The scan transistor SCT may be connected to a data line DL and the first node N1 of the driving transistor DRT.

The scan transistor SCT may control the connection between the first node N1 of the driving transistor DRT and a corresponding data line DL among the plurality of data lines DL in response to a scan signal SCAN transferred through a corresponding scan signal line SCL among a plurality of scan signal lines SCL, i.e., a type of gate lines GL.

The drain node or the source node of the scan transistor SCT may be electrically connected to the corresponding data line DL. The source node or the drain node of the scan transistor SCT may be electrically connected to the first node N1 of the driving transistor DRT. The gate node of the scan transistor SCT may be electrically connected to the scan signal line SCL, i.e., a type of gate line GL, to receive the scan signal SCAN applied through the scan signal line SCL.

The scan transistor SCT may be turned on by the scan signal SCAN having a turn-on level voltage to transfer the data voltage Vdata transferred through the corresponding data line DL to the first node N1 of the driving transistor DRT.

The scan transistor SCT is turned on by the scan signal SCAN having a turn-on level voltage and turned off by the scan signal SCAN having a turn-off level voltage. When the scan transistor SCT is an N-type transistor, the turn-on level voltage may be a high level voltage, and the turn-off level voltage may be a low level voltage. When the scan transistor SCT is a P-type transistor, the turn-on level voltage may be a low level voltage, and the turn-off level voltage may be a high level voltage.

The storage capacitor Cst may be electrically connected to the first node N1 and the second node N2 of the driving transistor DRT to maintain the data voltage Vdata corresponding to an image signal voltage or a voltage corresponding thereto during a one-frame time.

The storage capacitor Cst may be an external capacitor intentionally designed to be provided outside of the driving transistor DRT, rather than a parasitic capacitor (e.g. Cgs or Cgd), i.e., an internal capacitor, present between the first node N1 and the second node N2 of the driving transistor DRT.

Since the subpixel SP illustrated in FIG. 2 includes two transistors DRT and SCT and one capacitor Cst to drive the emitting device ED, the subpixel SP is referred to as having a 2T1C structure (where T refers to a transistor and C refers to a capacitor).

Referring to FIG. 3, in the display device 100 according to embodiments, each of the subpixels SP may further include a sensing transistor SENT for an initialization operation, a sensing operation, and the like.

In this case, the subpixel SP illustrated in FIG. 3 includes three transistors DRT, SCT, and SENT and one capacitor Cst to drive the emitting device ED, and thus is referred to as having a 3T1C structure.

The sensing transistor SENT may be connected to the second node N2 of the driving transistor DRT and a reference voltage line RVL.

The sensing transistor SENT may control the connection between the second node N2 of the driving transistor DRT electrically connected to the pixel electrode PE of the emitting device ED and a corresponding reference voltage line RVL among a plurality of reference voltage lines RVL in response to a sensing signal SENSE transferred through a corresponding sensing signal line SENL among a plurality of sensing signal lines SENL, i.e., a type of gate line GL.

The drain node or the source node of the sensing transistor SENT may be electrically connected to the reference voltage line RVL. The source node or the drain node of the sensing transistor SENT may be electrically connected to the second node N2 of the driving transistor DRT, and electrically connected to the pixel electrode PE of the emitting device ED. The gate node of the sensing transistor SENT may be electrically connected to the sensing signal line SENL, i.e., a type of gate line GL, to receive the sensing signal SENSE applied therethrough.

The sensing transistor SENT may be turned on to apply a reverence voltage Vref supplied through the reference voltage line RVL to the second node N2 of the driving transistor DRT.

The sensing transistor SENT is turned on by the sensing signal SENSE having a turn-on level voltage, and turned off by the sensing signal SENSE having a turn-off level voltage. When the sensing transistor SENT is an N-type transistor, the turn-on level voltage may be a high level voltage and the turn-off level voltage may be a low level voltage. When the sensing transistor SENT is a P-type transistor, the turn-on level voltage may be a low level voltage and the turn-off level voltage may be a high level voltage.

Each of the driving transistor DRT, the scan transistor SCT, and the sensing transistor SENT may be an N-type transistor or a P-type transistor. All of the driving transistor DRT, the scan transistor SCT, and the sensing transistor SENT may be N-type transistors or P-type transistors. At least one of the driving transistor DRT, the scan transistor SCT, and the sensing transistor SENT may an N-type transistor (or a P-type transistor), and the remaining transistors may be P-type transistors (or N-type transistors).

The scan signal line SCL and the sensing signal line SENL may be different gate lines GL. In this case, the scan signal SCAN and the sensing signal SENSE may be separate gate signals, and the on-off timing of the scan transistor SCT and the on-off timing of the sensing transistor SENT in a single subpixel SP may be independent of each other. That is, the on-off timing of the scan transistor SCT and the on-off timing of the sensing transistor SENT in the single subpixel SP may be the same or different.

Alternatively, the scan signal line SCL and the sensing signal line SENL may be the same gate line GL. That is, the gate node of the scan transistor SCT and the gate node of the sensing transistor SENT in a single subpixel SP may be connected to a single gate line GL. In this case, the scan signal SCAN and the sensing signal SENSE may be the same gate signal, and the on-off timing of the scan transistor SCT and the on-off timing of the sensing transistor SENT in the single subpixel SP may be the same.

The reference voltage line RVL may be disposed every single subpixel column. Alternatively, the reference voltage line RVL may be disposed every two or more subpixel columns. When the reference voltage line RVL is disposed every two or more subpixel columns, two or more subpixels SP may be supplied with the reference voltage Vref through a single reference voltage line RVL. For example, each reference voltage line RVL may be disposed every 4 subpixel columns. That is, a single reference voltage line RVL may be shared by subpixels SP in 4 subpixel columns.

The driving voltage line DVL may be disposed every subpixel column. Alternatively, the driving voltage line DVL may be disposed every two or more subpixel columns. When the driving voltage line DVL are disposed every two or more subpixel columns, two or more subpixels SP may be supplied with the driving voltage EVDD through a single driving voltage line DVL. For example, each driving voltage line DVL may disposed every 4 subpixel columns. That is, a single driving voltage line DVL may be shared by subpixels SP in 4 subpixel columns.

The 3T1C structure of the subpixel SP illustrated in FIG. 3 is provided for illustrative purposes only. Rather, the subpixel structure may further include one or more transistors, or in some cases, one or more capacitors. In addition, all of the plurality of subpixels may have the same structure, or some of the plurality of subpixels may have a different structure.

In addition, the display device 100 according to embodiments may have a top emission structure or a bottom emission structure.

Meanwhile, since each of the plurality of subpixels SP disposed in the display panel 110 includes at least one of the emitting device ED and the driving transistor DRT, a plurality of emitting devices ED and a plurality of driving transistors DRT may be disposed in the display panel 110.

Each of the plurality of emitting devices ED may have unique characteristics (e.g., a threshold voltage). Each of the plurality of driving transistors DRT may have unique characteristics (e.g., a threshold voltage and mobility).

The characteristics of the emitting device ED may change with increases characteristics of the in the driving time of the emitting device ED. The characteristics of the driving transistor DRT may change with increases in the driving time of the driving transistor DRT.

The plurality of subpixels SP may have different driving times.

Thus, changes in the characteristics of the emitting device ED in each of the plurality of subpixels SP may be different from those of the emitting devices ED in other subpixels SP. Consequently, a characteristic deviation may occur among the emitting devices ED.

In addition, changes in the characteristics of the driving transistor DRT in each of the plurality of subpixels SP may be different from those of the driving transistors DRT in other subpixels SP. Consequently, a characteristic deviation may occur among the driving transistors DRT.

The characteristic deviation among the emitting devices ED or the driving transistors DRT may lead to luminance deviation among the subpixels SP. Consequently, the luminance uniformity of the display panel 110 may be reduced, thereby degrading the image quality of the display panel 110.

In this regard, the display device 100 according to embodiments may provide a compensation function to reduce the characteristic deviation among the circuit devices (e.g., the emitting devices ED and the driving transistors DRT) of each of the subpixels SP, and may include a compensation system (e.g., a compensation circuit) to provide the compensation function. Hereinafter, the compensation function and the compensation system for providing the compensation function will be described.

As will be described below, the display device 100 according to embodiments may perform the compensation function by at least one compensation method of a sensing-based compensation method and a sensingless-based compensation method.

Figure 4:
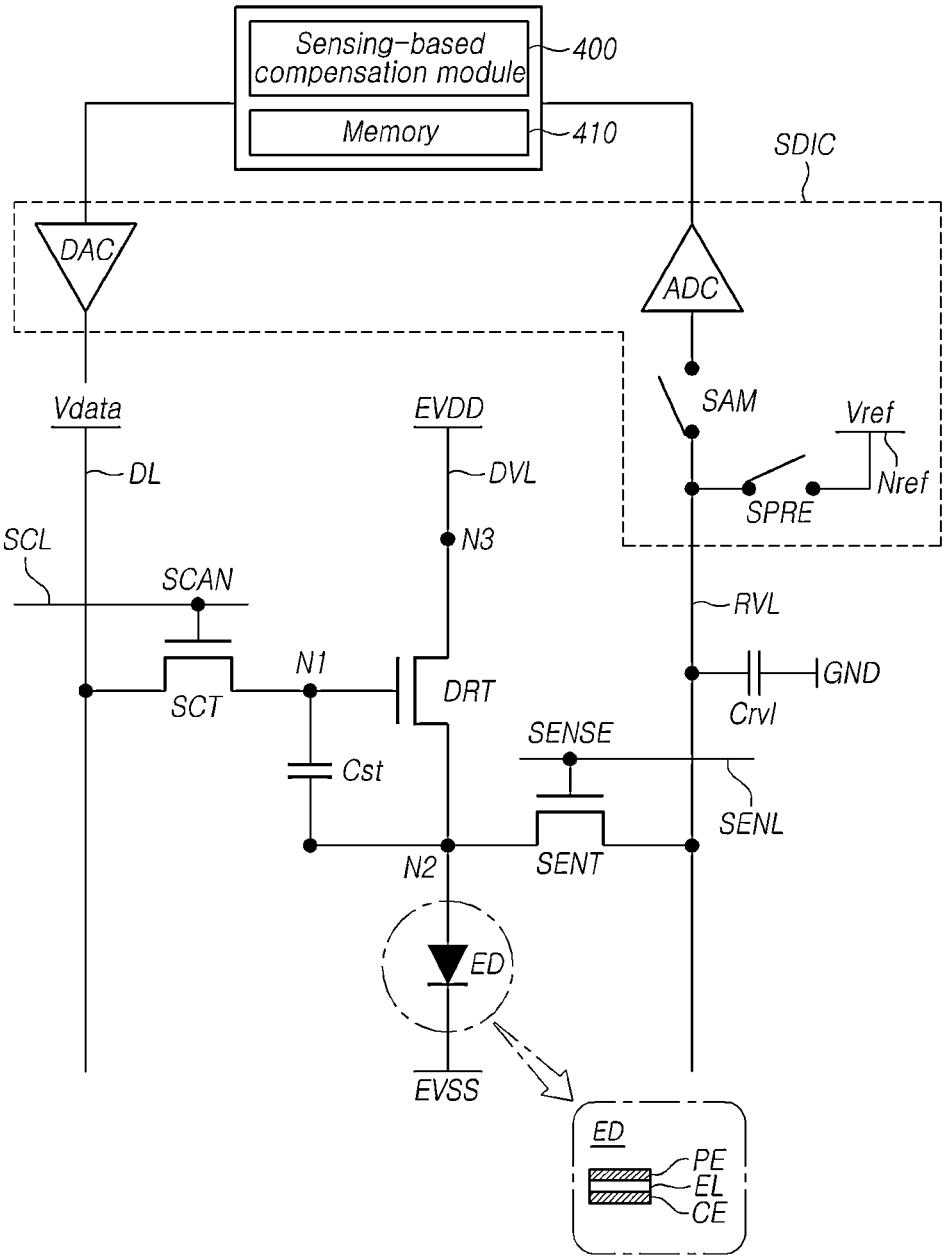
FIG. 4 illustrates a sensing-based compensation circuit of the display device according to embodiments.

FIG. 4 illustrates a sensing-based compensation circuit of the display device 100 according to embodiments.

Referring to FIG. 4, the compensation circuit is a circuit able to perform sensing and compensation of characteristics of circuit devices in each subpixel SP.

The compensation circuit may be connected to the subpixels SP, and include a power switch SPRE, a sampling switch SAM, an analog-to-digital converter ADC, a sensing-based compensation module 400, and the like The power switch SPRE may control the connection between the reference voltage line RVL and a reference voltage supply node Nref. The reference voltage Vref output from the power supply may be supplied to the reference voltage supply node Nref, and reference voltage Vref supplied to the reference voltage supply node Nref may be applied to the reference voltage line RVL through the power switch SPRE.

The sampling switch SAM may control the connection between the analog-to-digital converter ADC and the reference voltage line RVL. When connected to the reference voltage line RVL by the sampling switch SAM, the analog-to-digital converter ADC may convert a voltage on the connected reference voltage line RVL (corresponding to an analogue value) into a sensing value corresponding to a digital value.

A line capacitor Crvl may be formed between the reference voltage line RVL and the ground GND. A voltage on the reference voltage line RVL may correspond to a state of charge of the line capacitor Crvl.

The analog-to-digital converter ADC may obtain a sensing value by which characteristics of the circuit device may be reflected or determined, generate sensing data including the obtained sensing value, and provide sensing data including the sensing value to the sensing-based compensation module 400, in response to sensing driving.

The sensing-based compensation module 400 may actually determine the characteristics of the circuit devices of the corresponding subpixel SP, on the basis of the sensing data sensed by the sensing driving. Here, the circuit devices may include at least one of the emitting device ED and the driving transistor DRT.

The sensing-based compensation module 400 may calculate a compensation value on the basis of the determined characteristics of the circuit device in each of the subpixels SP, generate compensation data including the calculated compensation value, and store the generated compensation data in the memory 410.

For example, the compensation data is information for reducing characteristic deviation among the emitting devices ED or the driving transistors DRT. The compensation data may include offset and gain values for changing data.

The controller 140 may change image data using the compensation data (e.g., the compensation value) stored in the memory 410, and transfer the changed image data to the data driver circuit 120.

The data driver circuit 120 may output a data voltage Vdata corresponding to an analogue value by converting the changed image data into the data voltage Vdata using a digital-to-analog converter DAC. Consequently, the compensation may finally be realized.

Referring to FIG. 4, the analog-to-digital converter ADC, the power switch SPRE, and the sampling switch SAM may be included in a source driver integrated circuit SDIC of the data driver circuit 120. The sensing-based compensation module 400 may be included in the controller 140. The memory 410 may be implemented as one or more memories. The memory 410 may be present inside or outside of the controller 140. When the memory 410 is implemented as two or more memories, one of the two or more memories may be an internal memory of the controller 140, whereas the other of the two or more memories may be an external memory of the controller 140. Here, the external memory may be a double data rate (DDR) memory.

As described above, the display device 100 according to embodiments may perform compensation to reduce the characteristic deviation among the circuit devices in the subpixels SP. In this regard, the display device 100 may perform the sensing driving to determine the characteristics of the circuit devices in the subpixels SP.

For example, the sensing driving may include at least one of sensing driving for determining the characteristics of the driving transistors DRT and sensing driving for determining the characteristics of the emitting devices ED.

A change in the threshold voltage or mobility of the driving transistor DRT may mean the deterioration of the driving transistor DRT, and a change in the threshold voltage of the emitting device ED may mean the deterioration of the emitting device ED.

Thus, the sensing driving for determining the characteristics of the circuit devices in the subpixels SP may be referred to as sensing driving for determining the deterioration (e.g., the degrees of deterioration) of the circuit devices in the subpixels SP. The characteristic deviation among the circuit devices in the subpixels SP may also mean a deterioration deviation (e.g., a deviation in the degree of deterioration) among the circuit devices in the subpixels SP.

The display device 100 according to embodiments may perform the sensing driving in two modes (i.e., a fast mode and a slow mode). Hereinafter, the sensing driving in two modes (i.e., the fast mode and the slow mode) will be described with reference to FIGS. 5 and 6.

Figure 5:
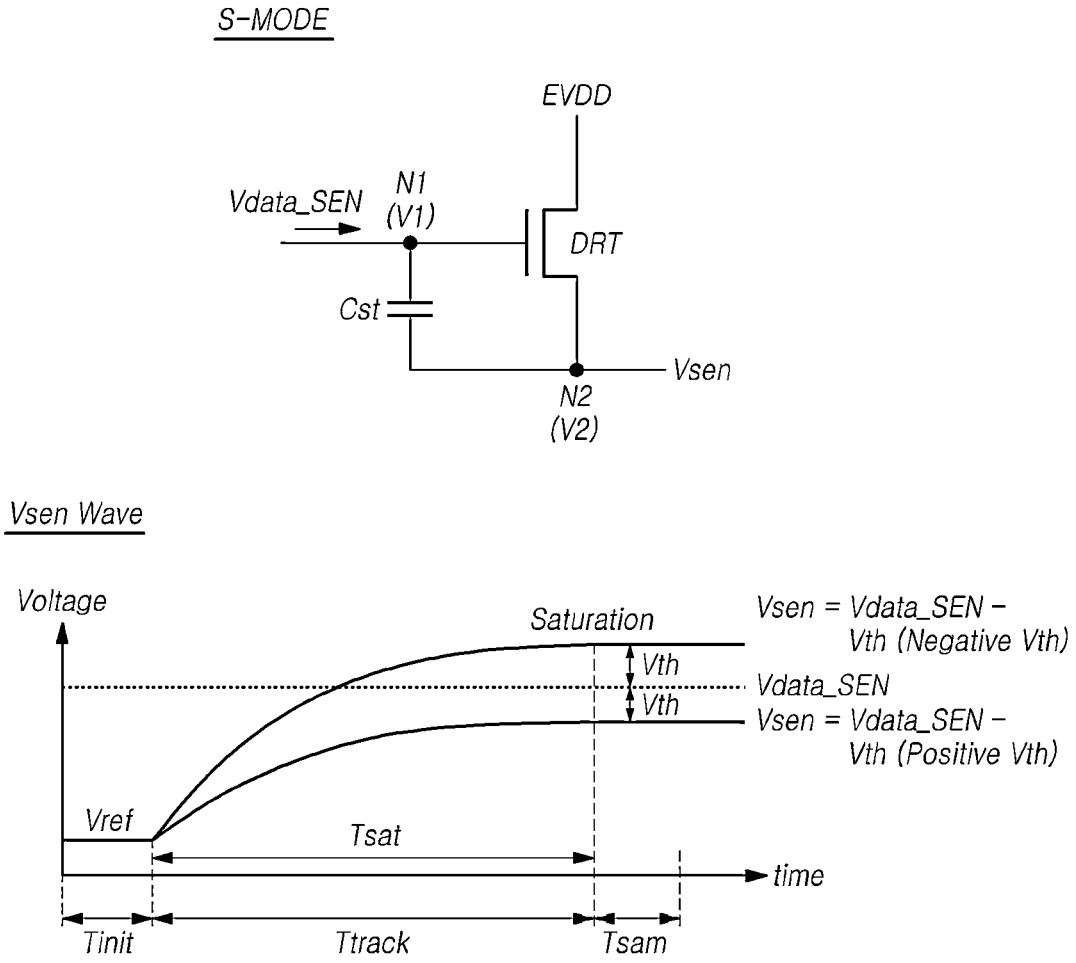
FIG. 5 is a diagram illustrating the sensing driving of the display device according to embodiments in the slow mode.
Figure 6:
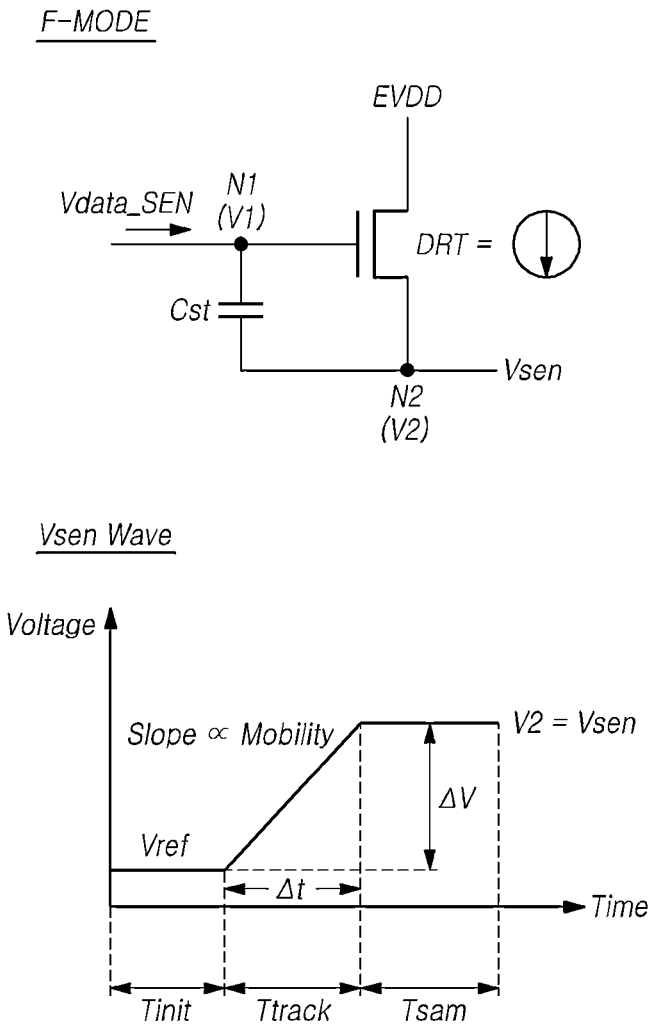
FIG. 6 is a diagram illustrating the sensing driving of the display device according to embodiments in the fast mode.

FIG. 5 is a diagram illustrating the sensing driving of the display device 100 according to embodiments in the slow mode (hereinafter, referred to as the "S mode"), and FIG. 6 is a diagram illustrating the sensing driving of the display device 100 according to embodiments in the fast mode (hereinafter, referred to as the "F mode").

Referring to FIG. 5, the S mode is a sensing driving mode in which specific characteristics (e.g., a threshold voltage) requiring a relatively-long driving time among characteristics (e.g., the threshold voltage and mobility) of the driving transistor DRT are sensed at a lower rate.

Referring to FIG. 6, the F mode is a sensing driving mode in which specific characteristics (e.g., a threshold voltage) requiring a relatively-short driving time among characteristics (e.g., the threshold voltage and mobility) of the driving transistor DRT are sensed at a higher rate.

Referring to FIGS. 5 and 6, each of the sensing driving time of the S mode and a sensing driving time of the F mode may include an initialization time Tinit, a tracking time Ttrack, and a sampling time Tsam. Hereinafter, the sensing driving time of the S mode and the sensing driving time of the F mode will be described.

First, the sensing driving time of the S mode of the display device 100 will be described with reference to FIG. 5.

Referring to FIG. 5, the initialization time Tinit of the sensing driving time of the S mode is a time period in which the first node N1 and the second node N2 of the driving transistor DRT are initialized.

During the initialization time Tinit, a voltage V1 on the first node N1 of the driving transistor DRT may be initialized as a sensing driving data voltage Vdata_SEN, and a voltage V2 on the second node N2 of the driving transistor DRT may be initialized as a sensing driving reference voltage Vref.

During the initialization time Tinit, the scan transistor SCT and the sensing transistor SENT may be turned on, and the power switch SPRE may be turned on.

Referring to FIG. 5, the tracking time Ttrack of the sensing driving time of the S mode is a time period in which a voltage V2 on the second node N2 of the driving transistor DRT reflecting a threshold voltage Vth of the driving transistor DRT or a change in the threshold voltage Vth is tracked.

During the tracking time Ttrack, the power switch SPRE may be turned off or the sensing transistor SENT may be turned off.

Thus, during the tracking time Ttrack, the first node N1 of the driving transistor DRT may maintain a constant voltage state having the sensing driving data voltage Vdata_SEN, whereas the second node N2 of the driving transistor DRT may be in an electrically floated state. Thus, during the tracking time Ttrack, the voltage V2 on the second node N2 of the driving transistor DRT may change.

During the tracking time Ttrack, until the voltage V2 on the second node N2 of the driving transistor DRT reflects the threshold voltage Vth of the driving transistor DRT, the voltage V2 on the threshold voltage Vth of the driving transistor DRT may be increased.

During the initialization time Tinit, a voltage difference between the first node N1 and the second node N2 may be equal to or higher than the threshold voltage Vth of the driving transistor DRT. Thus, when the tracking time Ttrack starts, the driving transistor DRT is in a turned-on state and allows a current to flow therethrough. Consequently, when the tracking time Ttrack starts, the voltage V2 on the second node N2 of the driving transistor DRT may be increased.

During the tracking time Ttrack, the voltage V2 on the second node N2 of the driving transistor DRT is not continuously increased.

The increment of the voltage V2 on the second node N2 of the driving transistor DRT decreases toward the end of the tracking time Ttrack. As a result, the voltage V2 on the second node N2 of the driving transistor DRT may be saturated.

The saturated voltage V2 on the second node N2 of the driving transistor DRT may correspond to a difference Vdata_SEN−Vth between the data voltage Vdata_SEN and the threshold voltage Vth or a difference Vdata_SEN−ΔVth between the data voltage Vdata_SEN and a threshold voltage deviation ΔVth. Here, the threshold voltage Vth may be a negative threshold voltage Negative Vth or a positive threshold voltage Positive Vth.

When the voltage V2 on the second node N2 of the driving transistor DRT is saturated, the sampling time Tsam may be started.

Referring to FIG. 5, the sampling time Tsam of the sensing driving time of the S mode is a time period in which the threshold voltage Vth of the driving transistor DRT or the voltage Vdata_SEN−Vth or Vdata_SEN-ΔVth reflecting a change in the threshold voltage Vth is measured.

The sampling time Tsam of the sensing driving time of the S mode is a time period in which to which the analog-to-digital converter ADC senses a voltage on the reference voltage line RVL. Here, the voltage on the reference voltage line RVL may correspond to the voltage on the second node N2 of the driving transistor DRT, and correspond to a charging voltage on the line capacitor Crvl formed on the reference voltage line RVL.

During the sampling time Tsam, the voltage Vsen sensed by the analog-to-digital converter ADC may be the voltage Vdata_SEN−Vth obtained by subtracting the threshold voltage Vth from the data voltage Vdata_SEN or the voltage Vdata_SEN-ΔVth obtained by subtracting the threshold voltage deviation ΔVth from the data voltage Vdata_SEN. The threshold voltage Vth may be a positive threshold voltage or a negative threshold voltage.

Referring to FIG. 5, during the tracking time Ttrack of the sensing driving time of the S mode, a time taken for the voltage V2 on the second node N2 of the driving transistor DRT to be saturated after having been increased is referred to as a saturation time Tsat. The saturation time Tsat may be a time length of the tracking time Ttrack of the sensing driving time of the S mode, and be a time taken for the threshold voltage Vth of the driving transistor DRT or a change thereof to be reflected on the voltage V2=Vdata_SEN−Vth on the second node N2 of the driving transistor DRT.

The saturation time Tsat may occupy most of the entire time length of the sensing driving time of the S mode. In the S mode, a significantly long time (e.g., the saturation time Tsat) may be taken for the voltage V2 on the second node N2 of the driving transistor DRT to be saturated after having been increased.

As described above, a sensing driving method for sensing the threshold voltage of the driving transistor DRT requires a relatively-long saturation time Tsat until the voltage state of the second node N2 of the driving transistor DRT exhibits the threshold voltage of the driving transistor DRT, and thus is referred to as the slow (S) mode.

The sensing driving time of the F mode of the display device 100 will be described with reference to FIG. 6.

Referring to FIG. 6, the initialization time Tinit of the sensing driving time of the F mode is a time period in which the first node N1 and the second node N2 of the driving transistor DRT are initialized.

During the initialization time Tinit, the scan transistor SCT and the sensing transistor SENT may be turned on, and the power switch SPRE may be turned on.

During the initialization time Tinit, a voltage V1 on the first node N1 of the driving transistor DRT may be initialized as a sensing driving data voltage Vdata_SEN, and a voltage V2 on the second node N2 of the driving transistor DRT may be initialized as a sensing driving reference voltage Vref.

Referring to FIG. 6, the tracking time Ttrack of the sensing driving time of the F mode is a time period in which a voltage V2 on the second node N2 of the driving transistor DRT is changed during a predetermined tracking time Δt until the voltage V2 on the second node N2 of the driving transistor DRT is in a voltage state reflecting the mobility of the driving transistor DRT or a change in the mobility.

During the tracking time Ttrack, the predetermined tracking time Δt may be set to be relatively short. Thus, during the short tracking time Δt, the voltage V2 on the second node N2 of the driving transistor DRT may not properly reflect the threshold voltage Vth. However, during the short tracking time Δt, the voltage V2 on the second node N2 of the driving transistor DRT may be changed so that the mobility of the driving transistor DRT is determined.

Accordingly, the F mode is a sensing driving method for sensing the mobility of the driving transistor DRT.

In the tracking time Ttrack, the power switch SPRE is turned off or the sensing transistor SENT is turned off, and thus the second node N2 of the driving transistor DRT may be in an electrically floated state.

During the tracking time Ttrack, in response to the scan signal SCAN having a turn-off level voltage, the scan transistor SCT may be in a turned-off state, and the first node N1 of the driving transistor DRT may be a floated state.

During the initialization time Tinit, a difference in the voltage between the first node N1 and the second node N2 of the driving transistor DRT initialized may be equal to or higher than the threshold voltage Vth of the driving transistor DRT. Thus, when the tracking time Ttrack starts, the driving transistor DRT is in a turned-on state and allows a current to flow therethrough.

Here, when the first node N1 and the second node N2 of the driving transistor DRT are a gate node and a source node, respectively, the difference in the voltage between the first node N1 and the second node N2 of the driving transistor DRT is Vgs.

Thus, during the tracking time Ttrack, the voltage V2 on the second node N2 of the driving transistor DRT may be increased. At this time, the voltage V1 on the first node N1 of the driving transistor DRT may also be increased.

During the tracking time Ttrack, the increasing rate of the voltage V2 on the second node N2 of the driving transistor DRT varies depending on the current capability (i.e., mobility) of the driving transistor DRT. The greater the current capability (i.e., mobility) of the driving transistor DRT, the faster the voltage V2 on the second node N2 of the driving transistor DRT may be increased.

After the tracking time Ttrack has existed during the predetermined tracking time Δt, i.e., the voltage V2 on the second node N2 of the driving transistor DRT has been increased during the predetermined tracking time Δt, a sampling time Tsam may start.

During the tracking time Ttrack, the increasing rate of the voltage V2 on the second node N2 of the driving transistor DRT corresponds to a voltage change ΔV on the second node N2 of the driving transistor DRT during the predetermined tracking time Δt. Here, the voltage change ΔV on the second node N2 of the driving transistor DRT may correspond to a voltage change on the reference voltage line RVL.

Referring to FIG. 6, after the tracking time Ttrack has existed during the predetermined tracking time Δt, the sampling time Tsam may start. During the sampling time Tsam, the sampling switch SAM may be turned off, and the reference voltage line RVL and the analog-to-digital converter ADC may be electrically connected.

The analog-to-digital converter ADC may sense a voltage on the reference voltage line RVL. The voltage Vsen sensed by the analog-to-digital converter ADC may be a voltage Vref+ΔV increased from the reference voltage Vref by the voltage change ΔV during the predetermined tracking time Δt.

The voltage Vsen sensed by the analog-to-digital converter ADC may be the voltage on the reference voltage line RVL, and be the voltage on the second node N2 electrically connected to the reference voltage line RVL through the sensing transistor SENT.

Referring to FIG. 6, in the sampling time Tsam of the sensing driving time of the F mode, the voltage Vsen sensed by the analog-to-digital converter ADC may vary depending on the mobility of the driving transistor DRT. The sensing voltage Vsen increases with increases in the mobility of the driving transistor DRT. In contrast, the sensing voltage Vsen decreases with decreases in the mobility of the driving transistor DRT.

As described above, the sensing driving method for sensing the mobility of the driving transistor DRT is only required to change the voltage on the second node N2 of the driving transistor DRT for the short time Δt, and thus is referred to as the fast (F) mode.

Referring to FIG. 5, the display device 100 according to embodiments may determine the threshold voltage Vth of the driving transistor DRT in the corresponding subpixel SP or a change of the threshold voltage Vth on the basis of the voltage Vsen sensed in the S mode, calculate a threshold voltage compensation value by which a threshold voltage deviation among the driving transistors DRT is reduced or removed, and store the calculated threshold voltage compensation value in the memory 410.

Referring to FIG. 6, the display device 100 according to embodiments may determine the mobility of the driving transistor DRT in the corresponding subpixel SP or a change of the mobility on the basis of the voltage Vsen sensed in the F mode, calculate a mobility compensation value by which a mobility deviation among the driving transistors DRT is reduced or removed, and store the calculated mobility compensation value in the memory 410.

When the data voltage Vdata for the display driving is supplied to the corresponding subpixel SP, the display device 100 may supply the data voltage Vdata changed on the basis of the threshold voltage compensation value and the mobility compensation value.

As described above, the threshold voltage sensing may be performed in the S mode since the characteristic of the threshold voltage sensing requires a relatively-long sensing time, and the mobility sensing may be performed in the F mode since the characteristic of the mobility sensing requires a relatively-short sensing time.

Figure 7:
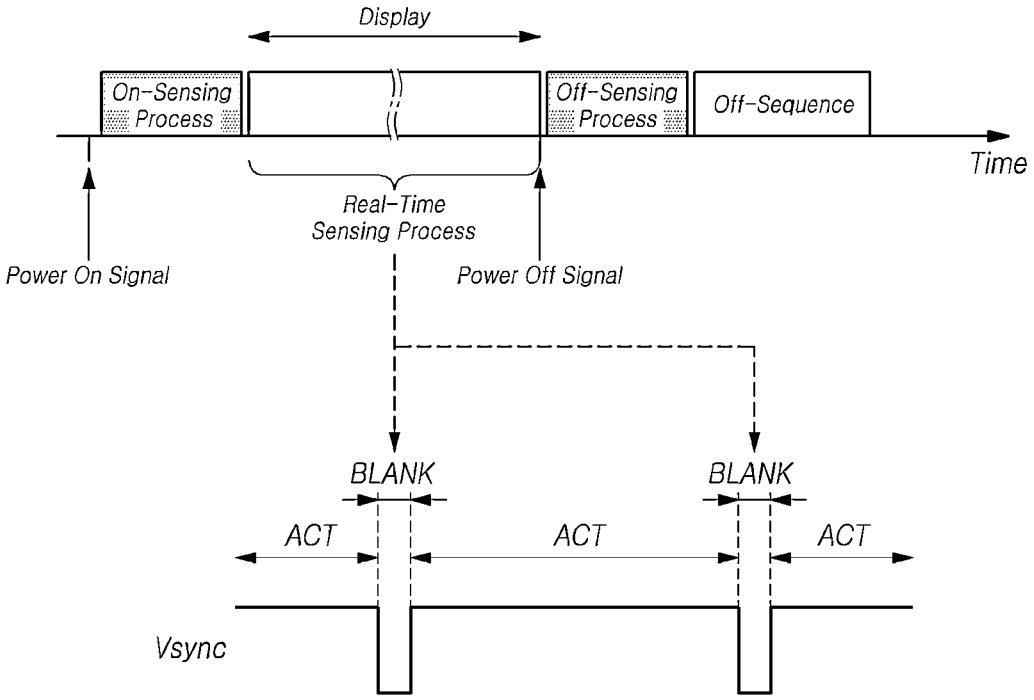
FIG. 7 is a timing diagram illustrating a variety of sensing driving times in the display device according to embodiments.

FIG. 7 is a timing diagram illustrating a variety of sensing driving times in the display device 100 according to embodiments.

Referring to FIG. 7, when a power-on signal is generated, the display device 100 according to embodiments may sense the characteristics of the driving transistor DRT in each of the subpixels SP disposed in the display panel 110. Such a sensing process is referred to as an "on-sensing process".

Referring to FIG. 7, when a power-off signal is generated, the display device 100 according to embodiments may sense the characteristics of the driving transistor DRT in each of the subpixels SP disposed in the display panel 110 before an OFF sequence, such as power off, occurs. Such a sensing process is referred to as an "off-sensing process".

Referring to FIG. 7, the display device 100 according to embodiments may sense the characteristics of the driving transistor DRT in each of the subpixels SP during the display driving before the power-off signal is generated after the generation of the power-on signal. Such a sensing process is referred to as a "real-time sensing process".

The real-time sensing process may be performed during every blank times BLANK between active times ACT in the case of a vertical synchronization signal Vsync.

Since the mobility sensing of the driving transistor DRT requires only a short time, the mobility sensing may be performed in the F mode during the sensing driving method.

Since the mobility sensing of the driving transistor DRT requires only a short time, the mobility sensing may be performed by any one of the on-sensing process, the off-sensing process, and the real-time sensing process.

The mobility sensing taking a shorter time than the mobility sensing may be performed by the real-time sensing process.

In contrast, the threshold voltage sensing of the driving transistor DRT requires a long saturation time Vsat. Thus, the threshold voltage sensing may be performed in the S mode during the sensing driving method.

The threshold voltage sensing of the driving transistor DRT should be performed by timing at which a user is not obstructed from watching the display device. Thus, the threshold voltage sensing of the driving transistor DRT may be performed while the display driving is not performed (i.e., a user is not intended to watch the display device) after the generation of the power-off signal by a user input or the like. That is, the threshold voltage sensing of the driving transistor DRT may be performed by the off-sensing process.

Figure 8:
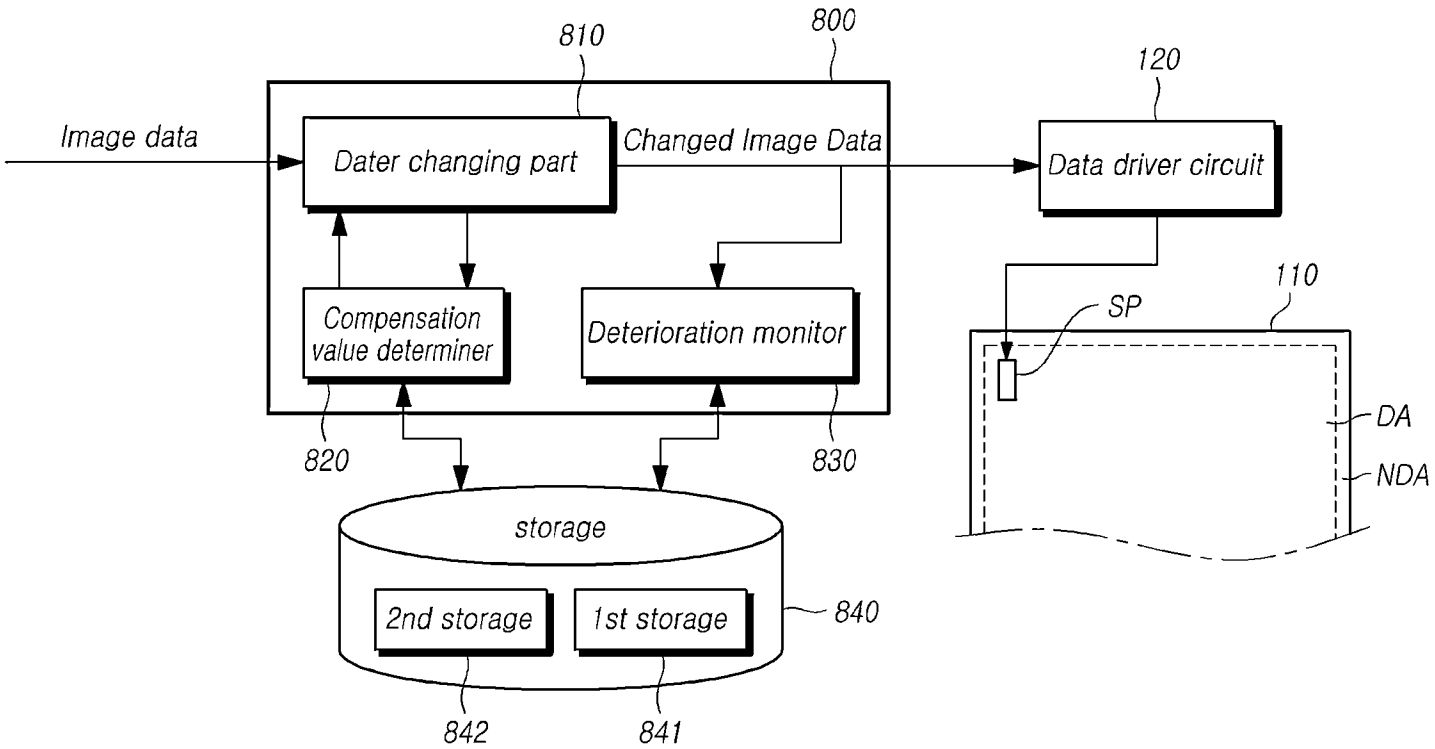
FIG. 8 illustrates a sensing-less compensation system according to embodiments.
Figure 9:
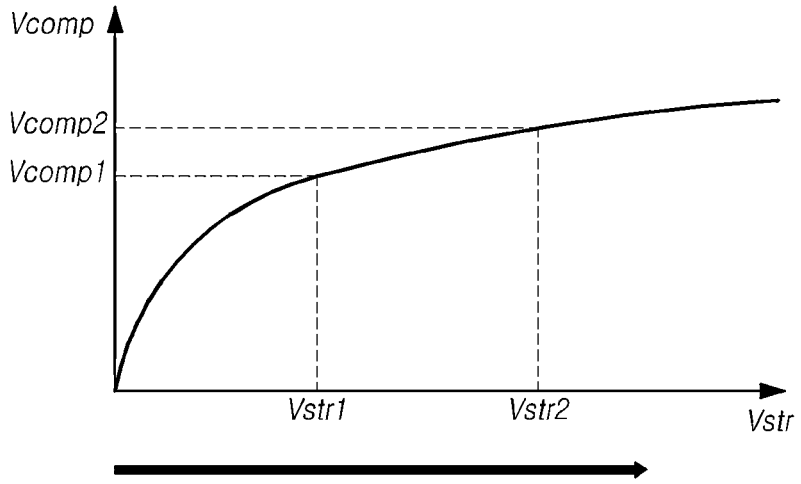
FIG. 9 is a graph illustrating a sensing-less compensation method according to embodiments.

FIG. 8 illustrates a sensing-less compensation system according to embodiments, and FIG. 9 is a graph illustrating a sensing-less compensation method according to embodiments.

Referring to FIG. 8, the sensing-less compensation system according to embodiments may include a sensing-less compensation module 800 and a storage 840.

The sensing-less compensation module 800 may generate compensation data by data accumulation of each of the subpixels SP without performing the sensing driving.

The storage 840 may store the compensation data generated by the sensing-less compensation module 800. In addition, the storage 840 may store information (or data) indicating the degree of deterioration of each of the circuit devices (e.g., the emitting device and the driving transistor) disposed in the subpixel SP, and store the compensation data including compensation values each matching the degree of deterioration according to the subpixel SP.

At least one of the sensing-less compensation module 800 and the storage 840 may be included in the controller 140. Alternatively, at least one of the sensing-less compensation module 800 and the storage 840 may be positioned outside of the controller 140. In some cases, the controller 140 may include only a portion of components of the sensing-less compensation module 800 and components of the storage 840.

The sensing-less compensation module 800 may include a data changing part 810, a compensation value determiner 820, and a deterioration monitor 830.

The data changing part 810 may receive image data from an external source. The data changing part 810 may perform data change processing to change the image data on the basis of the compensation data and output changed image data (also referred to as compensated image data) to the data driver circuit 120 according to the result of the data change processing.

For example, the data changing part 810 may perform the data change processing by, for example, addition, subtraction, or multiplication between the image data according to the subpixel SP and the corresponding compensation value.

The data changing part 810 may determine the compensation data to be added to the image data by the compensation value determiner 820 in order to generate the changed image data.

The compensation value determiner 820 may determine the degree of deterioration of the circuit device disposed in the subpixel SP on the basis of the data stored in the storage 840. The compensation value determiner 820 may determine the compensation value corresponding to the degree of deterioration of the circuit device and output the compensation value to the data changing part 810.

The storage 840 may be implemented as a single storage or, in some cases, as two or more storages 841 and 842. For example, the storage 840 may include a first storage 841 and a second storage 842.

The first storage 841 may store information (or data) regarding the degree of deterioration of the circuit device accumulated in real time according to the driving of the subpixel SP. Here, the information regarding the degree of deterioration of the subpixel SP may be referred to as cumulative stress data.

The second storage 842 may store the compensation data matching the cumulative stress data. The second storage 842 may store the compensation data matching the cumulative stress data, for example, in the form of a lookup table.

The data changing part 810 may determine the compensation value regarding the cumulative stress data of the subpixel SP from the compensation data stored in the second storage 842 by the compensation value determiner 820, perform the data change processing using the determined compensation value, and output the changed image data generated by the data change processing to the data driver circuit 120.

The data driver circuit 120 may generate an analog data voltage Vdata on the basis of the changed image data received from the sensing-less compensation module 800, and supply the generated data voltage Vdata to the subpixel SP. Thus, the data voltage Vdata in which the compensation data is reflected according to the degree of deterioration of the subpixel SP, may be supplied to the subpixel SP.

For example, as illustrated in FIG. 9, when the cumulative stress data is a first stress value Vstr1, changed image data in which a first compensation value Vcomp1 corresponding to the first stress value Vstr1 is reflected may be input to the data driver circuit 120. When the cumulative stress data is a second stress value Vstr2, changed image data in which a second compensation value Vcomp2 corresponding to the second stress value Vstr2 is reflected may be input to the data driver circuit 120.

The data driver circuit 120 may supply the data voltage Vdata in which the compensation data according to the cumulative stress data of the subpixel SP is reflected to the subpixel SP. The deterioration of the circuit device disposed in the subpixel SP may be compensated for in real time, and the driving of the subpixel SP may be performed.

The cumulative stress data of the subpixel SP may be updated in real time while the subpixel SP is being driven.

The deterioration monitor 830 may receive the changed image data that the data changing part 810 outputs.

As the data voltage Vdata according to the changed image data is supplied to the subpixel SP and the driving time of the subpixel SP accumulates, the subpixel SP may be further deteriorated.

The deterioration monitor 830 may update the cumulative stress data of the subpixel SP stored in the first storage 841 according to the changed image data.

Since the cumulative stress data of the subpixel SP is updated by the deterioration monitor 830 during the driving of the subpixel SP, the information regarding the deterioration of the circuit device in the subpixel SP stored in the first storage 841 may be updated and managed in real time as the cumulative stress data.

The deterioration monitor 830 may store the cumulative stress data of the subpixel SP as the original data in the first storage 841.

Alternatively, the deterioration monitor 830 may store the cumulative stress data of the subpixel SP in the first storage 841 by compressing the entirety or a portion of the cumulative stress data. In this case, the deterioration monitor 830 may perform a compression function and a decompression function to the cumulative stress data. Here, the compression function may also be referred to as an encoding function, whereas the decompression function may also be referred to as a decoding function.

The compensation value determiner 820 may determine the degree of deterioration of the circuit device disposed in each of the plurality of subpixels SP on the basis of the cumulative stress data updated in the first storage 841.

The compensation value determiner 820 may calculate the compensation value regarding the subpixel SP corresponding to the changed deterioration of the subpixel SP on the basis of the updated cumulative stress data, and update the compensation data stored in the second storage 842 with the calculated compensation value.

Figure 10:
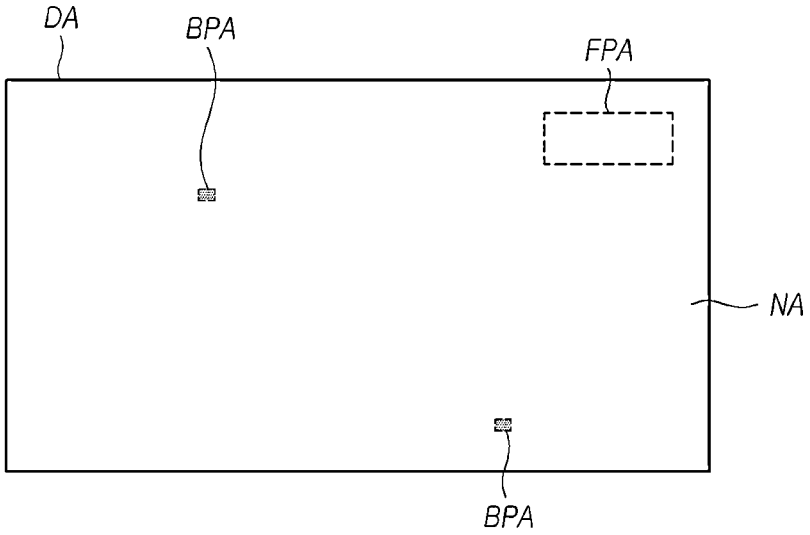
FIG. 10 illustrates three areas in a display area of the display panel in the display device according to embodiments.

FIG. 10 illustrates three areas NA, FPA, and BPA in a display area DA of the display panel 110 in the display device 100 according to embodiments.

Referring to FIG. 10, the display area DA of the display panel 110 according to embodiments may be divided into the three areas NA, FPA, and BPA.

For example, the three areas NA, FPA, and BPA may include a normal area NA, a fixed pattern area FPA, and a bad pixel area BPA.

The fixed pattern area FPA may be an area in which a single image is continuously displayed for a predetermined time or more. The bad pixel area BPA may be a pixel area in which a bad subpixel BSP is disposed. The normal area NA may be an area different from the fixed pattern area FPA and the bad pixel area BPA and in which normal images are displayed.

Hereinafter, the three areas NA, FPA, and BPA will be described in more detail.

The fixed pattern area FPA may be an area including a fixed position in which a single image is continuously displayed for at least a predetermined time.

The fixed pattern area FPA is an area in which an afterimage may appear even after the disappearance of a single image that has been continuously displayed for at least a predetermined time. Here, the predetermined time may mean a minimum time in which an image capable of forming an afterimage is continuously displayed.

For example, the fixed pattern area FPA may be an area in which logo information, channel information, program information, other information, and the like are displayed. The fixed pattern area FPA may be an area in which subpixels SP for displaying the logo information, the channel information, the program information, the other information, and the like are disposed.

In the display area DA, one or more fixed pattern areas FPA may be present. Each of the fixed pattern areas FPA may be present in a variety of positions in the display area DA. The position of each of the fixed pattern areas FPA may be changed in the display area DA.

The bad pixel area BPA may include one or more pixels each of which is not normally driven or does not normally emit light. Here, such a pixel which is not normally driven or does not normally emit light may be referred to as a bad pixel. For example, one pixel may include two or more subpixels.

The bad pixel may include subpixels SP, at least one of which is not normally driven or does not normally emit light. Here, such a subpixel SP which is not normally driven or does not normally emit light may be referred to as a bad subpixel.

In an example, the bad subpixel may be a darkened subpixel or a brightened subpixel. When the bad subpixel is a darkened subpixel, the driving transistor DRT and the emitting device ED in the bad subpixel may be in an electrically disconnected state due to repair processing.

In another example, the emitting device ED in the bad subpixel may be electrically disconnected from the driving transistor DRT in the bad subpixel while being electrically connected to the driving transistor DRT in another subpixel (i.e., a normal subpixel). That is, the emitting device ED in the bad subpixel may be lit by the driving transistor DRT in another subpixel (i.e., a normal subpixel).

In another example, the bad subpixel may be a subpixel normalized by another normal subpixel. In this case, the bad subpixel may be a subpixel SP that is driven to emit light by receiving the data voltage Vdata supplied to another normal subpixel.

In the display area DA, one or more bad pixel areas BPA may be present. Each of the bad pixel areas BPA may be present in a variety of positions in the display area DA. The position of each of the bad pixel areas BPA may be changed in the display area DA.

The normal area NA may be an area different from the fixed pattern area FPA and the bad pixel area BPA. The normal area NA may be an area in which subpixels SP normally driven or normally emitting light are disposed.

Figure 11:
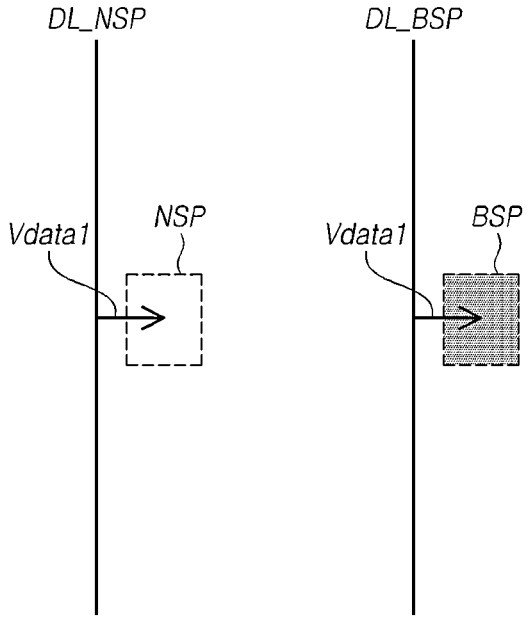
FIG. 11 illustrates the driving of a subpixel disposed in the bad pixel area in the display area of the display panel in the display device according to embodiments.

FIG. 11 illustrates the driving of a subpixel SP disposed in the bad pixel area BPA in the display area DA of the display panel 110 in the display device 100 according to embodiments.

Referring to FIG. 11, the display device 100 according to embodiments may drive a bad subpixel BSP using a normal subpixel NSP. Thus, the bad subpixel may be a subpixel normalized by another normal subpixel.

For example, in the data driver circuit 120 of the display device 100, a first data voltage Vdata1 supplied to a normal subpixel NSP may be equally supplied to at least one bad subpixel BSP.

The bad subpixel BSP and the normal subpixel NSP may be adjacent to each other. The normal subpixel NSP may receive the first data voltage Vdata1 through a first data line DL_NSP, and the bad subpixel BSP may receive the same first data voltage Vdata1 through a second data line DL BSP.

The normal subpixel NSP may be directly adjacent to and have a different color from the bad subpixel BSP. Alternatively, the normal subpixel NSP may be a subpixel SP most adjacent to the bad subpixel BSP among subpixels SP having the same color as the bad subpixel BSP.

Figure 12:
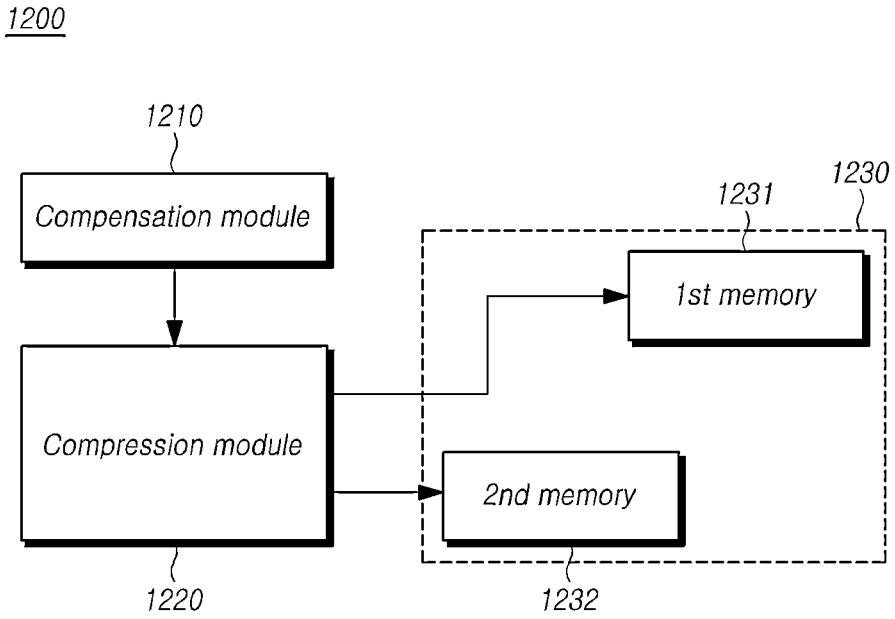
FIG. 12 illustrates a compensation system of the display device according to embodiments.

FIG. 12 illustrates a compensation system 1200 of the display device 100 according to embodiments.

Referring to FIG. 12, the display device 100 according to embodiments may include the compensation system 1200 generating and storing compensation data including compensation values regarding the subpixels SP.

Referring to FIG. 12, the compensation system 1200 according to embodiments may include a compensation module 1210 generating the compensation data regarding the subpixels SP and a storage 1230 storing the compensation data.

Meanwhile, there may be a large amount of compensation data regarding the subpixels SP. As the number of the subpixels SP increases with increases in the resolution of the display panel 110, the amount of the compensation data will increase.

In this manner, when the amount of the compensation data is significantly large, the capacity of the storage 1230 (i.e., the capacity of a storage space) storing the compensation data should also be increased.

Thus, the compensation system 1200 according to embodiments may store the compensation data by compressing the same. Thus, the compensation system 1200 according to embodiments may further include a compression module 1220 to generate compressed compensation data by compressing the compensation data. In this case, the storage 1230 may store the compressed compensation data.

The compression module 1220 may decompress the compressed compensation data stored in the storage 1230. The compensation module 1210 may provide changed image data to the data driver circuit 120 by performing data change processing using the compensation data decompressed by the compression module 1220.

The compensation module 1210 illustrated in FIG. 12 may be the sensing-based compensation module 400 illustrated in FIG. 4 or the sensing-less compensation module 800 illustrated in FIG. 8. The storage 1230 illustrated in FIG. 12 may be the memory 410 illustrated in FIG. 4 or the storage 840 illustrated in FIG. 8.

The compensation data generated by the compensation module 1210 may be compensation data generated on the basis of sensing values obtained by the sensing driving or compensation data generated by the data accumulation.

Although the storage 1230 may be implemented as a single memory, the storage 1230 may be implemented as two or more memories. For example, as illustrated in FIG. 12, the storage 1230 may include a first memory 1231 and a second memory 1232. For example, the first memory 1231 and the second memory 1232 may be present outside of the controller 140. Alternatively, one of the first memory 1231 and the second memory 1232 may be present outside of the controller 140, whereas the other of the first memory 1231 and the second memory 1232 may be present inside of the controller 140.

Figure 13:
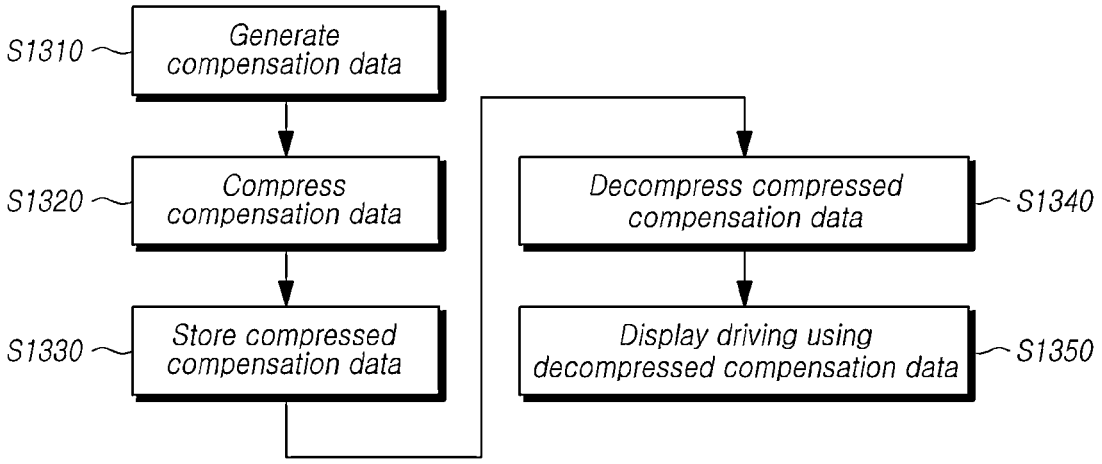
FIG. 13 is a flowchart illustrating a process in which the display device according to embodiments stores and manages compensation data by compressing the compensation data and decompresses the stored compressed compensation data to use the decompressed compensation data in the display driving.

FIG. 13 is a flowchart illustrating a process in which the display device 100 according to embodiments stores and manages compensation data by compressing the compensation data and decompresses the stored compressed compensation data to use the decompressed compensation data in the display driving.

Referring to FIG. 13, an operation method of the display device 100 according to embodiments may include an operation S1310 of generating compensation data of the subpixels SP, an operation S1320 of generating compressed compensation data by compressing the compensation data, and an operation S1330 of storing the compressed compensation data.

The compensation data generated in the operation S1310 may be sensing-based compensation data. In this case, prior to the operation S1310, the sensing driving described above with reference to FIGS. 4 to 7 may be performed. Consequently, the compensation data generated in the operation S1310 may be the compensation data generated from the sensing data obtained by the sensing driving.

The compensation data generated in the operation S1310 may be sensing-less compensation data. In this case, the compensation data may be compensation data generated by the sensing-less compensation module 800 illustrated in FIG. 8.

Referring to FIG. 13, the operation method of the display device 100 according to embodiments may further include an operation S1340 of decompressing the stored compressed compensation data and an operation S1350 of performing the display driving using the decompressed compensation data after the operation S1330.

Since the display area DA includes the normal area NA, the fixed pattern area FPA, and the bad pixel area BPA, the compensation data generated by the compensation module 1210 may include compensation data regarding some subpixels SP of the plurality of subpixels SP disposed in the normal area NA, compensation data regarding some subpixels SP of the plurality of subpixels SP disposed in the fixed pattern area FPA, and compensation data regarding some subpixels SP of the plurality of subpixels SP disposed in the bad pixel area BPA.

Hereinafter, for the sake of brevity, the compensation data regarding the subpixels SP disposed in the normal area NA may be referred to as compensation data regarding the normal area NA or normal compensation data, and may be briefly referred to as normal compensation data.

In addition, hereinafter, for the sake of brevity, the compensation data regarding the subpixels SP disposed in the fixed pattern area FPA may be referred to as compensation data regarding the fixed pattern area FPA or fixed compensation data, and may be briefly referred to as fixed compensation data.

Furthermore, hereinafter, for the sake of brevity, the compensation data regarding the subpixels SP disposed in the bad pixel area BPA may be referred to as compensation data regarding the bad pixel area BPA or, briefly, a flag. Here, the flag may include coordinate information, pixel information, and the like of at least one bad subpixel BSP disposed in the bad pixel area BPA. For example, the pixel information may include at least one of type information of the bad subpixel BSP and information regarding the normal subpixel NSP used for the normalization of the bad subpixel BSP. For example, the type information of the bad subpixel BSP may be information regarding a darkened subpixel, a brightened subpixel, a subpixel normalized using a normal subpixel NSP, and the like.

The compression module 1220 of the compensation system 1200 according to embodiments may uniformly compress the compensation data.

Thus, all of the compensation data regarding the subpixels SP disposed in the normal area NA, the compensation data (i.e., fixed compensation data) regarding the subpixels SP disposed in the fixed pattern area FPA, and the compensation data (i.e., the flag) regarding the subpixels SP disposed in the bad pixel area BPA may be compressed in the same manner.

The compensation function is a function to improve image quality. However, when the compression module 1220 uniformly compresses the compensation data, the deterioration of the image quality due to the compression may be increased, since characteristics of each of the normal area NA, the fixed pattern area FPA, and the bad pixel area BPA are not considered.

For example, the compression module 1220 may compress the compensation data regarding the subpixels SP in the entire areas in the same manner without taking into consideration of respective characteristics of the normal area NA, the fixed pattern area FPA, and the bad pixel area BPA.

However, in this case, an afterimage occurring in the fixed pattern area FPA may be clearer due to compression loss of the compensation data with respect to the fixed pattern area FPA. Such an afterimage caused by the compression loss is unavoidable even when an afterimage compensation method is applied.

In addition, due to the compression loss of the compensation data (i.e., flag) regarding the bad pixel area BPA, an abnormal data voltage Vdata may be applied to the bad subpixel BSP, thereby causing an abnormality in the screen.

Accordingly, embodiments of the present disclosure propose a method of compressing and decompressing compensation data to prevent the deterioration of image quality due to the compression of the compensation data.

Figure 14:
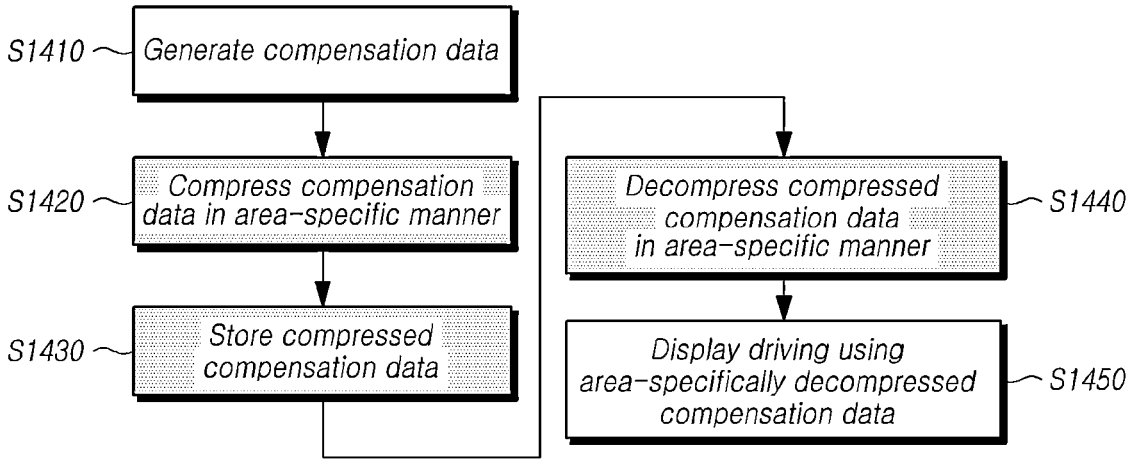
FIG. 14 is a flowchart illustrating a process in which the display device according to embodiments stores and manages compensation data by compressing the compensation data and decompresses the stored compressed compensation data in an area-specific manner to use the decompressed compensation data in the display driving.

FIG. 14 is a flowchart illustrating a process in which the display device 100 according to embodiments stores and manages compensation data by compressing the compensation data and decompresses the stored compressed compensation data in an area-specific manner to use the decompressed compensation data in the display driving.

Referring to FIG. 14, the operation method of the display device 100 according to embodiments may include an operation S1410 of generating compensation data regarding some subpixels SP of the plurality of subpixels SP disposed in the normal area NA, the fixed pattern area FPA, and the bad pixel area BPA, an operation S1420 of generating compressed compensation data by compressing the compensation data, an operation S1430 of storing the compressed compensation data, and the like.

In the operation S1420, the compressed compensation data generated by the compression module 1220 may include compressed compensation data regarding the normal area NA, compressed compensation data regarding the fixed pattern area FPA, and compressed compensation data regarding the bad pixel area BPA.

In the operation S1420, the compression module 1220 may compress the compensation data in different methods in an area-specific manner.

The compressed compensation data regarding the normal area NA may include normal compensation data processed by encoding. For example, the compressed compensation data obtained by compressing the normal compensation data regarding the normal area NA may be compensation data compressed by the joint photographic experts group (JPEG). When the normal compensation data regarding the normal area NA is compressed by the JPEG, the data may be processed by a discrete cosine transform (DCT). The "encoding" stated above may be the DCT.

The compressed compensation data regarding the fixed pattern area FPA may include fixed compensation data processed by the encoding and error information resulting from the encoding. For example, the compressed compensation data obtained by compressing the fixed compensation data regarding the fixed pattern area FPA may include error information (hereinafter, also referred to as a difference value) resulting from the compression of the fixed compensation data by the JPEG. The "encoding" stated above may be the DCT.

The compressed compensation data regarding the bad pixel area BPA may include the flag regarding the bad pixel area BPA. For example, the flag of the bad pixel area BPA, i.e., the compressed compensation data regarding the bad pixel area BPA, may be losslessly compressed data.

The storage 1230 may include a first memory 1231 and a second memory 1232.

The first memory 1231 may include error information resulting from the encoding included in the compressed compensation data regarding the fixed pattern area FPA.

The first memory 1231 may store the flag of the bad pixel area BPA.

The second memory 1232 may store the encoded normal compensation data as the compressed compensation data regarding the normal area NA.

The second memory 1232 may store the encoded fixed compensation data included in the compressed compensation data regarding the fixed pattern area FPA.

The first memory 1231 may be a memory different from the second memory 1232.

For example, the first memory 1231 may be positioned outside of the controller 140 that controls the driving of the display panel 110. For example, the first memory 1231 may be a double data rate (DDR) memory. The second memory 1232 may be an internal memory (e.g., a register or a buffer) of the controller 140.

For example, the flag regarding the bad pixel area BPA may include coordinate information and pixel information of at least one subpixel SP (e.g., bad subpixel BSP) disposed in the bad pixel area BPA. For example, the pixel information may include at least one of type information of the bad subpixel BSP and information regarding the normal subpixel NSP used for the normalization of the bad subpixel BSP. For example, the type information of the bad subpixel BSP may be information regarding a darkened subpixel, a brightened subpixel, a subpixel normalized using a normal subpixel NSP, and the like.

The at least one bad subpixel BSP disposed in the bad pixel area BPA may be a darkened subpixel SP, a brightened subpixel SP, a subpixel SP normalized to be driven to emit light by another normal subpixel NSP, or the like.

When the at least one bad subpixel BSP is the subpixel SP normalized to be driven to emit light by another normal subpixel NSP, a data voltage supplied to at least one another normal subpixel NSP may be equally supplied to the at least one bad subpixel BSP.

The at least one another normal subpixel NSP may be at least one subpixel SP having a different color and adjacent to the at least one another normal subpixel NSP or at least one subpixel SP most adjacent to at least one of subpixels SP having the same color as the at least one another normal subpixel NSP.

Meanwhile, the compression module 1220 performs the sampling before the encoding. The compression module 1220 may perform the sampling by sampling one or more pixels or one or more subpixels from every plurality of unit pixel areas UPA in the display panel 110 and extracting compensation data regarding the sampled one or more pixels or subpixels from compensation data generated by the compensation module 1210.

Since the compression module 1220 performs the sampling by selecting a portion of the entire compensation data and compresses the sampled compensation data, the rate and efficiency of the compression can be improved.

Meanwhile, the normal area NA may be an area containing more low-frequency components, whereas the fixed pattern area FPA may be an area containing more high-frequency components.

The normal area NA may contain more compensation data components of a first frequency than compensation data components of a second frequency higher than the first frequency. The fixed pattern area FPA may contain more compensation data components of the second frequency than compensation data components of the first frequency.

In the compression of the compensation data, the encoding may cause a loss in (or damage to) the data components of the second frequency (i.e., high frequency). Here, the second frequency is a high frequency, and may be a frequency greater than or equal to a predefined value. In addition, the first frequency is a low frequency, and may be a frequency less than a predefined value.

In the compensation data regarding subpixels SP disposed in the fixed pattern area FPA, compensation values of adjacent subpixels SP may have low relationships (e.g., correlation). That is, in the compensation data regarding subpixels SP disposed in the fixed pattern area FPA, compensation values of adjacent subpixels SP may be significantly different from each other.

In the compensation data regarding the subpixels SP disposed in the normal area NA, compensation values of adjacent subpixels SP may have high relationships (e.g., correlation or coefficients of correlation). That is, in the compensation data regarding the subpixels SP disposed in the normal area NA, the compensation values of the adjacent subpixels SP may have similar values.

As described above, the coefficients of correlation of the compensation value regarding the subpixels SP included in the compensation data regarding the fixed pattern area FPA may be lower than the coefficients of correlation (or relationships) of the compensation values regarding the subpixels SP included in the compensation data regarding the normal area NA. Here, the coefficients of correlation may be numerical values indicating the degrees of correlation between the compensation values. The more similar the compensation values, the higher the coefficients of correlation may be. The less similar the compensation values, the lower the coefficients of correlation may be.

Hereinafter, the operation S1420 of compressing the compensation data in an area specific manner and the operation S1430 of storing the compressed compensation data described above with reference to FIG. 14 will be described in more detail with reference to FIGS. 15 to 17, and an operation S1440 of decompressing the compressed compensation data in an area specific manner illustrated in FIG. 14 will be described in detail with reference to FIGS. 18 and 19.

Figure 15:
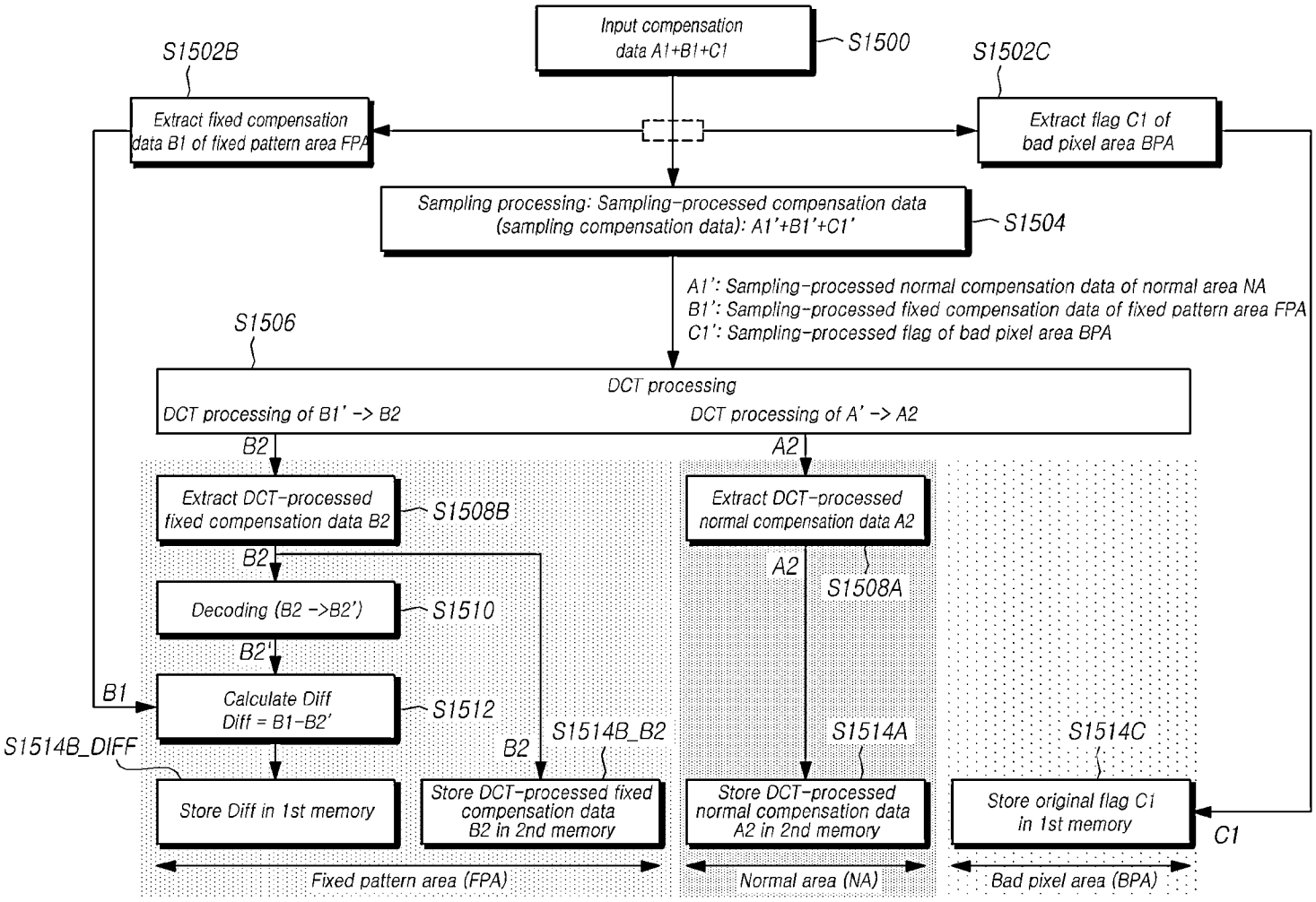
FIG. 15 is a flowchart illustrating a compensation data compression process by the compensation system according to embodiments.

FIG. 15 is a flowchart illustrating a compensation data compression process by the compensation system 1200 according to embodiments. FIG. 16 illustrates the decoding in the compensation data compression process by the compensation system 1200 according to embodiments. FIG. 17 is a diagram illustrating the sampling in the compensation data compression process by the compensation system 1200 according to embodiments.

Referring to FIG. 15, in an operation S1500, the compression module 1220 receives compensation data A1+B1+C1 generated by the compensation module 1210.

The compensation data A1+B1+C1 generated by the compensation module 1210 may include normal compensation data A1 regarding the normal area NA, fixed compensation data B1 regarding the fixed pattern area FPA, and a flag C1 regarding the bad pixel area.

In operations S1502B and S1502C, the compression module 1220 may extract the fixed compensation data B1 regarding the fixed pattern area FPA and the flag C1 regarding the bad pixel area from the compensation data A1+B1+C1 input from the compensation module 1210.

In an operation S1504, the compression module 1220 may perform sampling to the compensation data A1+B1+C1 input from the compensation module 1210 before or after the operations S1502B and S1502C or together with the operations S1502B and S1502C.

The compression module 1220 may sample compensation data A'+B'+C' to be DCT-processed from the compensation data A1+B1+C1 input from the compensation module 1210.

The sampled compensation data A'+B'+C', i.e., compensation data processed by the sampling, may be a portion of the compensation data A1+B1+C1 input from the compensation module 1210.

The sampled compensation data A'+B'+C' may include the sampling-processed normal compensation data A' of the normal area, the sampling-processed fixed compensation data B' of the fixed pattern area, and the sampling-processed flag C1 of the bad pixel area.

The above-described sampling may not be essential processing and may be omitted for compression performance.

In an operation S1506, the compression module 1220 may perform the DCT to the sampled compensation data A'+B'+C' obtained by the sampling.

In an operation S1506, the data obtained by the DCT may include DCT-processed fixed compensation data B2 and DCT-processed normal compensation data A2.

In operations S1508B and S1508A, the compression module 1220 may extract DCT-processed fixed compensation data B2 and DCT-processed normal compensation data A2 from the data obtained by the DCT.

After the operation S1508B, the compression module 1220 may perform decoding to the DCT-processed fixed compensation data B2 and obtain the decoding-processed fixed compensation data B2' in an operation S1510.

After the operation S1510, the compression module 1220 may receive the fixed compensation data B1 regarding the fixed pattern area FPA, receive the decoding-processed fixed compensation data B2', and calculate a difference Diff=B1−B2' between the fixed compensation data B1 regarding the fixed pattern area FPA and the decoding-processed fixed compensation data B2' in an operation S1512. Here, the difference Diff may be error information resulting from the encoding during the compression of the compensation data regarding the fixed pattern area FPA.

In an operation S1514B_DIFF, the compression module 1220 may store the difference Diff, calculated in the operation S1512, in the first memory 1231.

In an operation S1514B_B2, the compression module 1220 may store the DCT-processed fixed compensation data B2, extracted in the operation S1508, in the second memory 1232.

In an operation S1514A, the compression module 1220 may store the DCT-processed normal compensation data A2, extracted in the operation S1508A, in the second memory 1232.

In an operation S1514C, the compression module 1220 may store the flag C1 regarding the bad pixel area BPA, extracted in the operation S1502C, in the first memory 1231. Here, the flag C1 regarding the bad pixel area BPA stored in the first memory 1231 may be original data which has not been DCT-processed and is lossless.

As described above, the compression module 1220 can store the difference Diff regarding the fixed pattern area FPA in the first memory 1231, store the DCT-processed fixed compensation data B2 regarding the fixed pattern area FPA in the second memory 1232, store the DCT-processed normal compensation data A2 regarding the normal area NA in the second memory 1232, and store the flag C1 regarding the bad pixel area BPA in the first memory 1231. Consequently, the compression module 1220 can complete the process of compressing and storing the compensation data in an area-specific manner.

Figure 16:
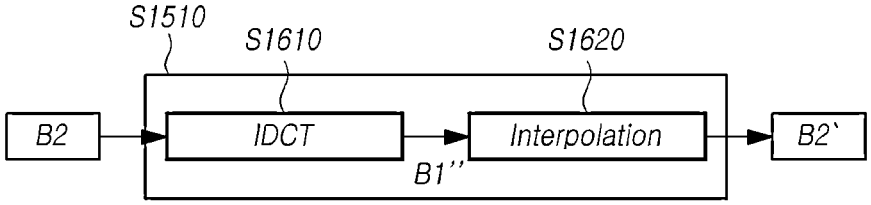
FIG. 16 illustrates the decoding in the compensation data compression process by the compensation system according to embodiments.

Referring to FIG. 16, the decoding operation S1510 may include an operation S1610 of performing an inverse discrete cosine transform (IDCT) to the DCT-processed fixed compensation data B2 and an operation S1620 of performing interpolation to the IDCT-processed fixed compensation data B" and outputting the decoding-processed fixed compensation data B2'.

The IDCT-processed fixed compensation data B1" may be the lossy (or damaged) fixed compensation data of the fixed pattern area processed by the sampling.

Figure 17:
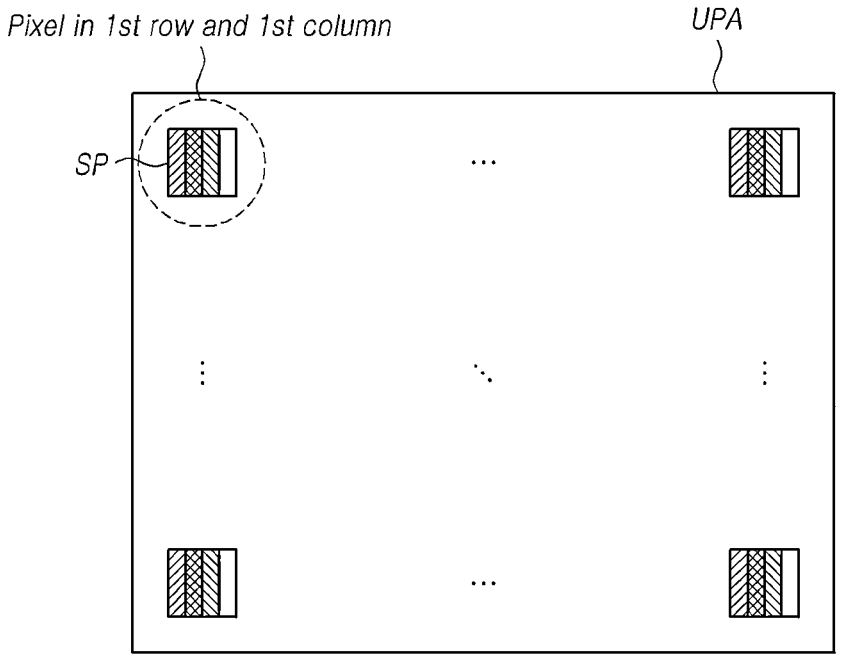
FIG. 17 is a diagram illustrating the sampling in the compensation data compression process by the compensation system according to embodiments.

Referring to FIG. 17, in the sampling operation S1504, the compensation data A'+B'+C' to be DCT-processed is sampled from the compensation data A1+B1+C1 input from the compensation module 1210. The sampling-processed compensation data A'+B'+C' may be a portion of the compensation data A1+B1+C1 input from the compensation module 1210.

According to the illustration of FIG. 17, four subpixels SP may constitute a single pixel, and a plurality of subpixels SP may constitute a plurality of pixels.

An area in which m rows and n columns of pixels among the plurality of pixels are arranged may correspond to a single unit pixel area UPA. For example, an area in which 8 rows and 8 columns of pixels (i.e., 64 pixels) are arranged may be a single unit pixel area UPA.

In each unit pixel area UPA, a pixel in the first row and the first column may be sampled as a pixel representing the unit pixel area UPA.

For example, in a situation in which K number of unit pixel areas UPA are present in the display panel 110 and m×n number of pixels are disposed in each of the K number of unit pixel areas UPA, a single pixel (e.g., the pixel in the first row and the first column) may be sampled from each of the K number of unit pixel areas UPA. That is, K number of pixels (i.e., 4×K number of subpixels SP) may be sampled from the entirety of the display panel 110.

Figure 18:
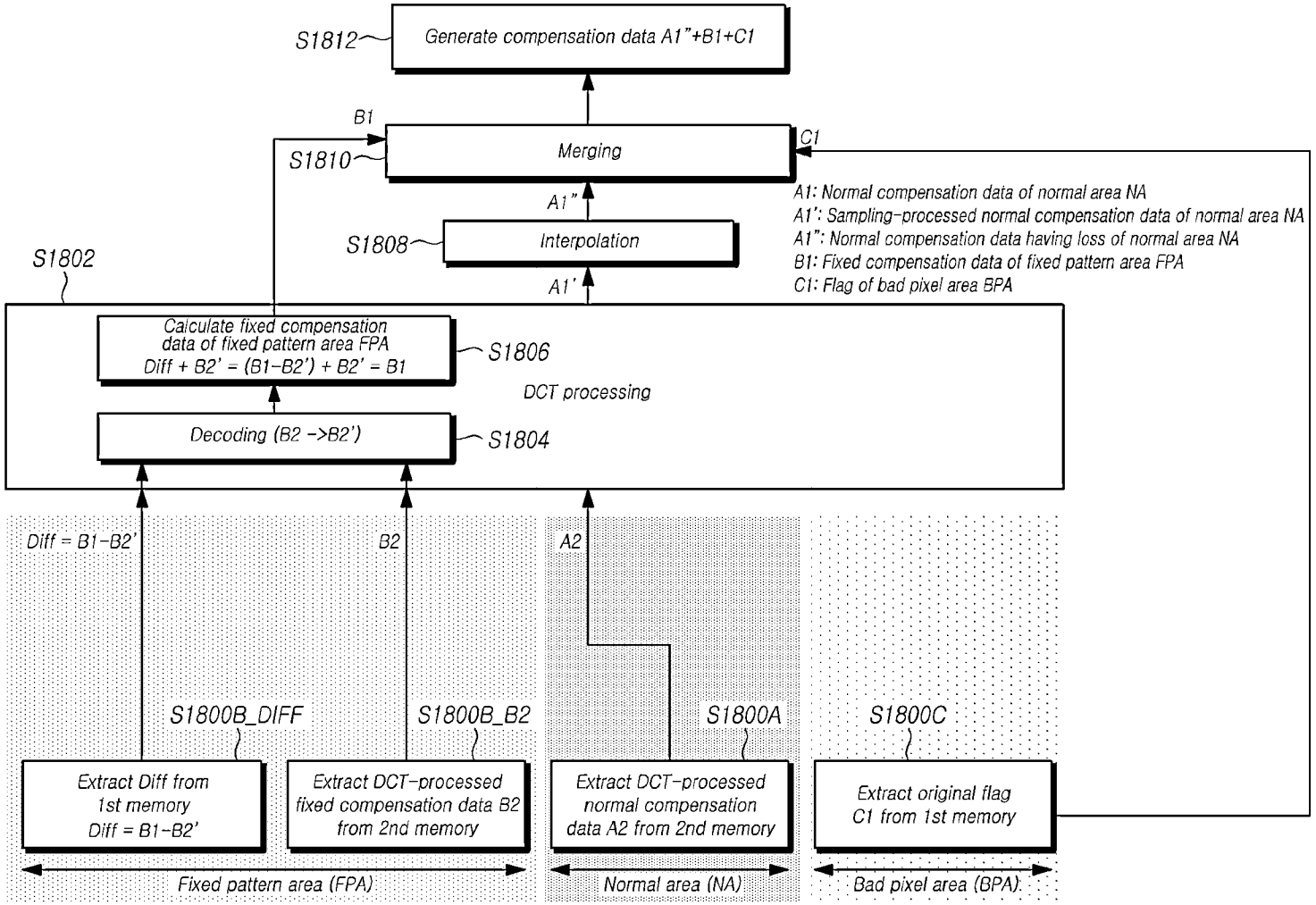
FIG. 18 is a flowchart illustrating the compensation data decompression process of the compensation system according to embodiments.

FIG. 18 is a flowchart illustrating the compensation data decompression process of the compensation system 1200 according to embodiments. FIG. 19 illustrates the decoding in the compensation data decompression process of the compensation system 1200 according to embodiments.

Referring to FIG. 18, in an operation S1800B_DIFF, the compression module 1220 may extract the difference Diff=B1-B2' regarding the fixed pattern area FPA from the first memory 1231.

In an operation S1800B_B2, the compression module 1220 may extract the DCT-processed fixed compensation data B2 regarding the fixed pattern area FPA from the second memory 1232.

In an operation S1800A, the compression module 1220 may extract the DCT-processed normal compensation data A2 regarding the normal area NA from the second memory 1232.

In an operation S1800C, the compression module 1220 may extract the flag C1 regarding the bad pixel area BPA from the first memory 1231.

In an operation S1802, the compression module 1220 may perform IDCT to the data extracted from the first memory 1231 and the second memory 1232 in the operations S1800B_DIFF, S1800B_B2, and S1800A.

The data extracted from the first memory 1231 and the second memory 1232 in the operations S1800B_DIFF, S1800B_B2, and S1800A may include the difference Diff=B1-B2' regarding the fixed pattern area FPA extracted from the first memory 1231, the DCT-processed fixed compensation data B2 regarding the fixed pattern area FPA extracted from the second memory 1232, and the DCT-processed normal compensation data A2 regarding the normal area NA extracted from the second memory 1232.

In the operation S1802, when performing the IDCT, the compression module 1220 may perform an operation S1804 of decoding DCT-processed fixed compensation data B2 regarding the fixed pattern area FPA and an operation S1806 of calculating the fixed compensation data B1 regarding the fixed pattern area FPA using the data B2' obtained as a result of the decoding and the difference Diff=B1−B2' regarding the fixed pattern area FPA extracted in the operation S1800B_DIFF.

The fixed compensation data B1 regarding the fixed pattern area FPA calculated in the operation S1806 may be obtained by summing the data B2' obtained as the result of the decoding and the difference Diff=B1−B2' regarding the fixed pattern area FPA extracted in the operation S1800B_DIFF.

The fixed compensation data B1 regarding the fixed pattern area FPA calculated in the operation S1806 may be fixed compensation data B1 regarding the fixed pattern area FPA extracted from the input compensation data A1+B1+C1 prior to the sampling in the compensation data compression process.

In the operation S1802, the compression module 1220 may obtain the normal compensation data A1' of the normal area NA sampling-processed in the compensation data compression process by performing the IDCT.

In an operation S1808, the compression module 1220 may perform interpolation to the sampling-processed normal compensation data A1' of the normal area NA. As a result, the compression module 1220 may obtain the interpolation-processed normal compensation data A1". Here, the interpolation-processed normal compensation data A1" may be the normal compensation data of the normal area NA, in which the high-frequency components are lossy.

The compression module 1220 may perform an operation S1810 of merging the interpolation-processed normal compensation data A1", the fixed compensation data B1 regarding the fixed pattern area FPA obtained by the IDCT, and the flag C1 regarding the bad pixel area BPA extracted from the first memory 1231 and an operation S1812 of generating the completely decompressed compensation data A"+B1+C1.

Figure 19:
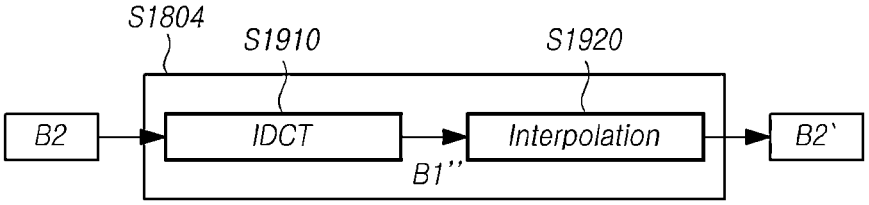
FIG. 19 illustrates the decoding in the compensation data decompression process of the compensation system according to embodiments.

Referring to FIG. 19, the decoding operation S1804 may include an operation S1910 of performing the IDCT to the DCT-processed fixed compensation data and an operation 51920 of outputting the decoding-processed fixed compensation data B2' by performing the interpolation to the IDCT-processed fixed compensation data B1".

The IDCT-processed fixed compensation data B1" may be the lossy fixed compensation data of the fixed pattern area processed by the sampling.

The embodiments of the present disclosure set forth above will be briefly described as follows.

According to the present disclosure, embodiments may provide a display device including: a display panel including a plurality of subpixels; a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include compressed compensation data regarding the normal area, compressed compensation data regarding the fixed pattern area, and compressed compensation data regarding the bad pixel area.

The compressed compensation data regarding the normal area may include normal compensation data processed by encoding, the compressed compensation data regarding the fixed pattern area include fixed compensation data processed by the encoding and error information resulting from the encoding, and the compressed compensation data regarding the bad pixel area includes a flag regarding the bad pixel area.

The encoding may be a DCT.

The flag of the bad pixel area which is the compressed compensation data regarding the bad pixel area may include losslessly compressed data.

The display device may further include: a first memory storing error information resulting from the encoding and the flag of the bad pixel area; and a second memory storing the normal compensation data processed by the encoding.

The second memory may be different from the first memory.

The display may further include a controller controlling the driving of the display panel. The first memory may be positioned outside of the controller, and the second memory may be an internal memory of the controller.

The flag may include coordinate information and pixel information regarding at least one subpixel disposed in the bad pixel area.

The at least one subpixel may be a darkened subpixel, a brightened subpixel, or a normalized subpixel driven using another subpixel.

The at least one subpixel may be supplied with a data voltage the same as that supplied to the at least one another subpixel.

The at least one another subpixel may be adjacent to the at least one subpixel and have a color different from that of the at least one subpixel. Alternatively, the at least one another subpixel may be most adjacent to the at least one subpixel among subpixels having the same color as that of the at least one subpixel.

The compression module may perform sampling prior to the encoding, wherein the sampling includes sampling one or more pixels from every plurality of unit pixel areas in the display panel and extracting compensation data regarding the sampled one or more pixels from the compensation data generated by the compensation module.

The normal area may be an area having a more low-frequency component, and the fixed pattern area may be an area having a more high-frequency component.

The normal area may contain a more compensation data component of a first frequency than a compensation data component of a second frequency higher than the first frequency. The fixed pattern area may contain a more compensation data component having the second frequency than a compensation data component having the first frequency.

The encoding may cause a loss to the data component of the second frequency.

Coefficients of correlation of compensation values regarding the subpixels included in the compensation data regarding the fixed pattern area may be lower than coefficients of correlation of compensation values regarding the subpixels included in the compensation data regarding the normal area.

The fixed pattern area may be an area in which a single image is continuously displayed for a predetermined time or more.

Embodiments may provide a compensation data compression method including: generating compensation data regarding subpixels disposed in a normal area, a fixed pattern area, and a bad pixel area; generating compressed compensation data by compressing the compensation data; and storing the compressed compensation data.

The compressed compensation data may include compressed compensation data regarding the normal area, compressed compensation data regarding the fixed pattern area, and compressed compensation data regarding the bad pixel area.

The compressed compensation data regarding the normal area includes normal compensation data processed by encoding, the compressed compensation data regarding the fixed pattern area may include fixed compensation data processed by the encoding and error information resulting from the encoding, and the compressed compensation data regarding the bad pixel area includes a flag regarding the bad pixel area.

The encoding may be a DCT.

The flag of the bad pixel area which is the compressed compensation data regarding the bad pixel area may be losslessly compressed data.

Coefficients of correlation of compensation values regarding the subpixels included in the compensation data regarding the fixed pattern area may be lower than coefficients of correlation of compensation values regarding the subpixels included in the compensation data regarding the normal area.

Embodiments may provide a compensation system including: a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include compressed compensation data regarding the normal area, compressed compensation data regarding the fixed pattern area, and compressed compensation data regarding the bad pixel area.

The compressed compensation data regarding the normal area may include normal compensation data processed by encoding, the compressed compensation data regarding the fixed pattern area may include fixed compensation data processed by the encoding and error information resulting from the encoding, and the compressed compensation data regarding the bad pixel area may include a flag regarding the bad pixel area.

The flag of the bad pixel area which is the compressed compensation data regarding the bad pixel area may be losslessly compressed data.

Embodiments may provide a compensation system including: a display panel including a plurality of subpixels; a compensation module generating compensation data regarding subpixels among the plurality of subpixels disposed in a normal area, a fixed pattern area, and a bad pixel area; and a compression module generating compressed compensation data by compressing the compensation data.

The compressed compensation data may include normal compensation data regarding the normal area, fixed compensation data regarding the fixed pattern area, and a flag regarding the bad pixel area.

The compression module may generate the compressed compensation data by compressing the normal compensation data, the fixed compensation data, and the flag in different manners.

The normal compensation data may be compressed by a DCT.

The flag may be included in the compressed compensation data in a lossless state.

As set forth above, according to embodiments, the display device, the compensation system, and the compensation data compression method can reduce the amount of compensation data.

According to embodiments, the compensation system, and the compensation data compression method can prevent image abnormalities and afterimages caused by the compression of compensation data.

According to embodiments, the display device, the compensation system, and the compensation data compression method can compress compensation data differently in an area-specific manner.

It will be apparent to those skilled in the art that various modifications and variations can be made in the display device, the compensation system, and the compensation data compression method of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device comprising:

a display panel comprising a plurality of subpixels;

a compensation module configured to generate compensation data regarding subpixels among the plurality of subpixels disposed in a normal area, a fixed pattern area, and a bad pixel area; and a compression module configured to generate compressed compensation data by compressing the compensation data, wherein the compressed compensation data comprises compressed compensation data regarding the normal area, compressed compensation data regarding the fixed pattern area, and compressed compensation data regarding the bad pixel area, wherein the compressed compensation data regarding the normal area comprises normal compensation data processed by encoding, the compressed compensation data regarding the fixed pattern area comprise fixed compensation data processed by the encoding and error information resulting from the encoding, and the compressed compensation data regarding the bad pixel area comprises a flag regarding the bad pixel area, wherein the normal area contains a more compensation data component of a first frequency than a compensation data component of a second frequency higher than the first frequency, and wherein the fixed pattern area contains a more compensation data component having the second frequency than a compensation data component having the first frequency.

2. The display device of claim 1, wherein the encoding comprises a discrete cosine transform.

3. The display device of claim 1, wherein the flag of the bad pixel area which is the compressed compensation data regarding the bad pixel area comprises losslessly compressed data.

4. The display device of claim 1, further comprising:

a first memory configured to store error information resulting from the encoding and the flag of the bad pixel area; and a second memory configured to store the normal compensation data processed by the encoding, wherein the second memory is different from the first memory.

5. The display device of claim 4, further comprising a controller controlling the driving of the display panel, wherein the first memory is positioned outside of the controller, and the second memory is an internal memory of the controller.

6. The display device of claim 1, wherein the flag comprises coordinate information and pixel information regarding at least one subpixel disposed in the bad pixel area.

7. The display device of claim 6, wherein the at least one subpixel comprises a darkened subpixel, a brightened subpixel, or a normalized subpixel driven using another subpixel.

8. The display device of claim 7, wherein the at least one subpixel is configured to be supplied with a data voltage the same as that supplied to the another subpixel.

9. The display device of claim 8, wherein the at least one another subpixel is adjacent to the at least one subpixel and has a color different from that of the at least one subpixel, or the at least one another subpixel is most adjacent to the at least one subpixel among subpixels having the same color as that of the at least one subpixel.

10. The display device of claim 1, wherein the compression module is configured to perform sampling prior to the encoding, wherein the sampling comprises sampling one or more pixels from every plurality of unit pixel areas in the display panel and extracting compensation data regarding the sampled one or more pixels from the compensation data generated by the compensation module.

11. The display device of claim 1, wherein the encoding causes a loss to the compensation data component of the second frequency.

12. The display device of claim 1, wherein coefficients of correlation of compensation values regarding the subpixels included in the compensation data regarding the fixed pattern area are lower than coefficients of correlation of compensation values regarding the subpixels included in the compensation data regarding the normal area.

13. The display device of claim 1, wherein the fixed pattern area is an area in which a single image is continuously displayed for a predetermined time or more.

14. A compensation data compression method, comprising:

generating compensation data regarding subpixels disposed in a normal area, a fixed pattern area, and a bad pixel area;

generating compressed compensation data by compressing the compensation data; and storing the compressed compensation data, wherein the compressed compensation data comprises compressed compensation data regarding the normal area, compressed compensation data regarding the fixed pattern area, and compressed compensation data regarding the bad pixel area, wherein the compressed compensation data regarding the normal area comprises normal compensation data processed by encoding, the compressed compensation data regarding the fixed pattern area comprises fixed compensation data processed by the encoding and error information resulting from the encoding, and the compressed compensation data regarding the bad pixel area comprises a flag regarding the bad pixel area, wherein the normal area contains a more compensation data component of a first frequency than a compensation data component of a second frequency higher than the first frequency, and wherein the fixed pattern area contains a more compensation data component having the second frequency than a compensation data component having the first frequency.

15. The compensation data compression method of claim 14, wherein the encoding comprises a discrete cosine transform.

16. The compensation data compression method of claim 14, wherein the flag of the bad pixel area which is the compressed compensation data regarding the bad pixel area comprises losslessly compressed data.

17. A compensation system, comprising:

a display panel comprising a plurality of subpixels;

a compensation module configured to generate compensation data regarding subpixels among the plurality of subpixels disposed in a normal area, a fixed pattern area, and a bad pixel area; and a compression module configured to generate compressed compensation data by compressing the compensation data, wherein the compressed compensation data comprises normal compensation data regarding the normal area, fixed compensation data regarding the fixed pattern area, and a flag regarding the bad pixel area, wherein the compression module generates the compressed compensation data by compressing the normal compensation data, the fixed compensation data, and the flag in different manners, wherein the normal area contains a more compensation data component of a first frequency than a compensation data component of a second frequency higher than the first frequency, and wherein the fixed pattern area contains a more compensation data component having the second frequency than a compensation data component having the first frequency.

18. The compensation system of claim 17, wherein the normal compensation data is compressed by a discrete cosine transform.

19. The compensation system of claim 17, wherein the flag is included in the compressed compensation data in a lossless state.

* * * * *